US007174752B2

(12) United States Patent
Galant

(10) Patent No.: US 7,174,752 B2
(45) **Date of Patent: *Feb. 13, 2007**

(54) EQUIPMENT SECURITY DEVICE

(75) Inventor: Steve N. Galant, Kleinburg (CA)

(73) Assignee: Compucage International Inc., Kleinburg (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/894,304

(22) Filed: Jul. 19, 2004

(65) Prior Publication Data

US 2004/0261474 A1 Dec. 30, 2004

Related U.S. Application Data

(63) Continuation-in-part of application No. 10/090,272, filed on Mar. 4, 2002, now Pat. No. 6,763,690.

(51) Int. Cl.
*E05B 69/00* (2006.01)

(52) U.S. Cl. ..... 70/58; 70/14; 70/18; 248/553

(58) Field of Classification Search ..... 70/14, 70/18, 19, 57, 58, 211; 248/551–553
See application file for complete search history.

(56) References Cited

U.S. PATENT DOCUMENTS 3,410,122 A 11/1968 Moses
3,965,705 A 6/1976 Nadler
4,696,449 A 9/1987 Woo et al.
4,738,127 A 4/1988 Johnson
5,052,198 A 10/1991 Watts
5,052,199 A 10/1991 Derman
5,135,197 A 8/1992 Kelley et al.
5,169,114 A 12/1992 O'Neill
5,582,044 A 12/1996 Bolich
5,595,074 A 1/1997 Munro
5,836,183 A 11/1998 Derman
5,857,568 A 1/1999 Speirs
5,927,108 A 7/1999 Pierce
6,138,483 A 10/2000 Galant
6,166,910 A * 12/2000 Ronberg et al. ..... 361/724
6,216,499 B1 4/2001 Ronberg et al.
6,237,375 B1 5/2001 Wymer
6,240,753 B1 6/2001 Wu
6,308,928 B1 10/2001 Galant
6,443,417 B2 9/2002 Galant
6,467,315 B1 10/2002 Edmondson
2002/0134119 A1* 9/2002 Derman ..... 70/58
2002/0157431 A1* 10/2002 Lurie et al. ..... 70/58

FOREIGN PATENT DOCUMENTS

EP 1 130 204 A2 9/2001

* cited by examiner

*Primary Examiner*—Suzanne Dino Barrett
(74) *Attorney, Agent, or Firm*—Hodgson Russ LLP

(57) ABSTRACT

A security device that can be used to secure devices, such as laptop computers, of varying sizes, and includes two securing members that are telescopically connected together and which have opposed restraining members for securing a device there between.

17 Claims, 21 Drawing Sheets

EQUIPMENT SECURITY DEVICE

RELATED APPLICATIONS

The application is a continuation-in-part of and claims priority to U.S. patent application Ser. No. 10/090,272 filed Mar. 4, 2002 now U.S. Pat. No. 6,763,690, currently pending.

FIELD OF INVENTION

The present invention relates to a security device for securing equipment such as a laptop computer to a structure.

BACKGROUND OF THE INVENTION

A variety of techniques and apparatus have been developed over the years to prevent the unauthorized removal of computers and other office equipment. A number of anti-theft devices have been developed specifically for tower style and desk top computers, as depicted for example in U.S. Pat. No. 6,138,483 issued Oct. 31, 2000 to Galant. Such devices are not designed to be used with clam shell style laptop computers which are most often the targets of computer theft.

Accordingly, it is desirable to provide an equipment security device which can easily be adjusted for use with laptop computers or equipment components of different sizes. It is also desirable to provide a security device that can be conveniently used to secure a laptop computer in both the opened and closed positions.

SUMMARY OF THE INVENTION

The invention provides a security device that can be used to secure devices, such as laptop computers, of varying sizes, and includes two securing members that are telescopically connected together and which have opposed restraining members for securing a device there between.

According to one example, there is provided a security device for securing a laptop computer, the security device including a first securing member including a first restraining member and an elongate arm, and a second securing member including a second restraining member opposing the first restraining member and a releasable locking device telescopically engaging the arm for preventing movement of the first and second restraining members away from each other when in an engagement position. The first and second restraining members each include spaced apart cover and base wall engagement members and a pair of side-wall engagement members for engaging a cover wall, base wall, and a pair of orthogonal side-walls, respectively, at diagonally opposite corners, respectively, of a closed laptop computer when in the engagement position.

According to another example, there is provided a method of securing a laptop computer including providing a security device having a pair of opposed restraining members telescopically connected together, each of the restraining members including spaced apart cover and base wall engagement members and a pair of side-wall engagement members for engaging a cover wall, base wall, and a pair of orthogonal side-walls, respectively, at diagonally opposite corners, respectively, of a closed laptop computer; and mounting the security device to a closed laptop computer with the restraining members engaging diagonally opposite corners of the closed laptop computer.

According to another example there is provided a security device for securing a laptop computer having a base and a cover pivotally connected together for movement between open and closed positions, the security device including comprising: opposed first and second restraining members telescopically connected together, each of the restraining members having a laptop cover engagement member, a base member for extending under a portion of a laptop base, and a joining member joining the base and cover engagement members, the cover members defining opposed openings for receiving opposite side-edge portions of an open cover of a laptop computer when the cover is open and the base members extend under respective portions of the laptop base for securing the laptop relative to the security device.

A security device for securing a laptop computer in either an open position or a closed position, including: opposed first and second restraining members telescopically connected together and lockable relative to each other in a plurality of positions, the restraining members each including: means for engaging the cover and base of an open laptop computer for restraining movement of the laptop when the restraining members are locked in a first one of the plurality of positions and means for engaging diagonally located corners of a closed laptop computer for restraining movement thereof when the restraining members are locked in a further one of the plurality of positions.

Other aspects of the present invention will become apparent to those ordinarily skilled in the art upon review of the following description of specific example embodiments of the invention in conjunction with the accompanying figures.

BRIEF DESCRIPTION OF THE DRAWINGS

For a better understanding of the invention, and to show how it may be carried into effect, reference will now be made, by way of example, to the accompanying drawings, like numerals being used to refer to like components throughout, in which.

DESCRIPTION OF EXAMPLE EMBODIMENTS

Figure 1:
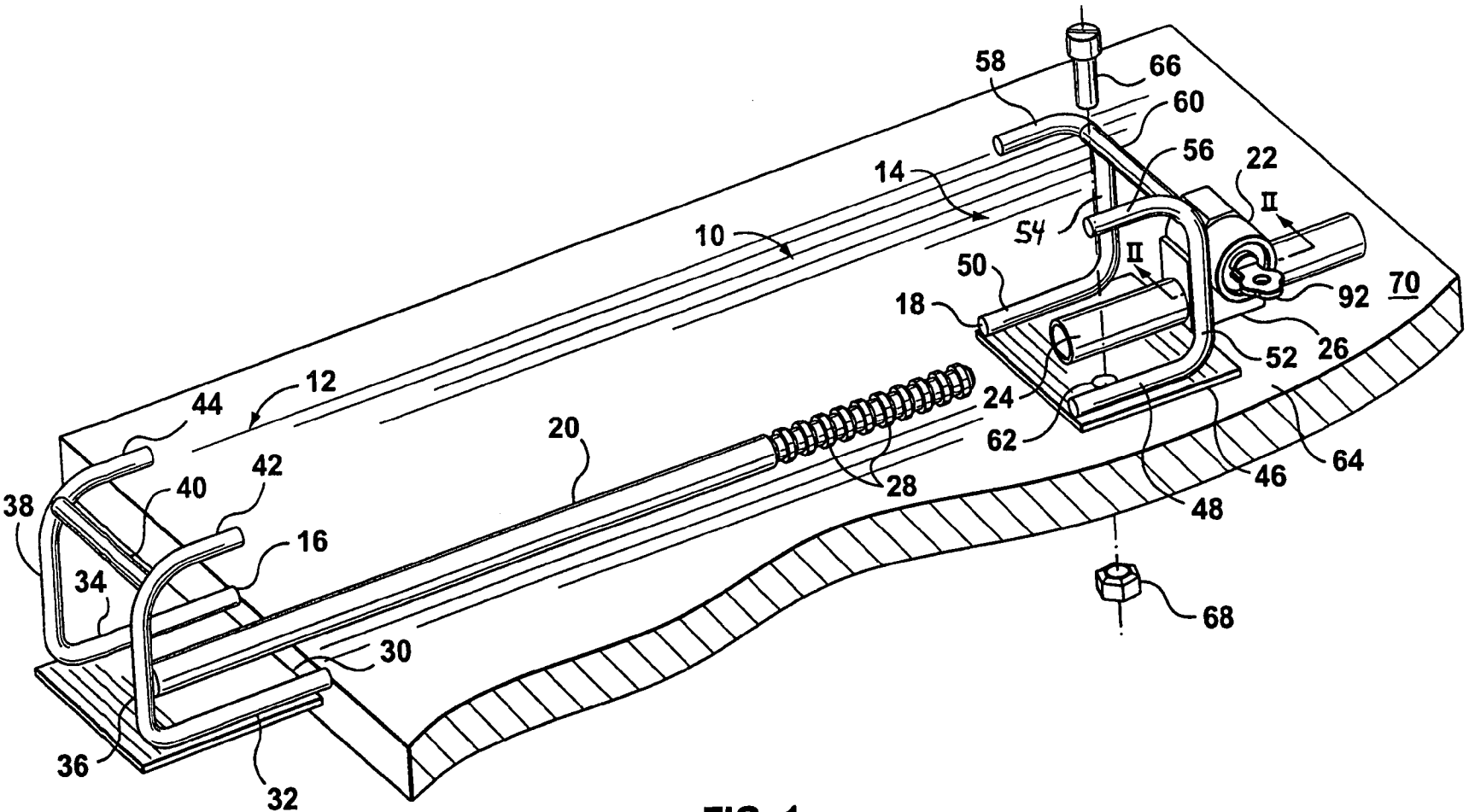
FIG. 1 is a perspective view of a security device in accordance with a first example embodiment of the invention.

The following description is of example embodiments by way of example only and without limitation to the combination of features necessary for carrying the invention into effect. With reference to FIG. 1, a security device in accordance with example embodiments of the invention is indicated by general reference number 10. The security device 10 includes first and second securing members 12 and 14 which can be telescopically connected together to secure a piece of equipment such as a laptop/notebook style computer therebetween, as will be explained in greater detail below. The first securing member 12 includes a first hook-like restraining member 16, and the second securing member 14 includes a second hook-like restraining member 18 for restraining movement of a secured laptop computer. An elongate cylindrical rod or arm 20 extends from the first securing member 12 in the same direction that the first hook member 16 opens towards. The second securing member 14 includes a lock device 22 which is configured to telescopically receive the locking arm 20 of the first securing member 12. In the illustrated embodiment, the lock device 22 includes a tubular sleeve 24 which has a lock assembly 26 mounted thereon for engaging ratchet teeth 28 that are provided along the length of an extending portion of the arm 20.

In the illustrated embodiment, the first hook member 16 includes a base plate 30 to which the locking arm 20 is rigidly attached. First and second base members 32, 34, are rigidly secured to the base plate 30 and run substantially parallel to a portion of the arm 20. First and second sidewall engagement members 36 and 38 extend orthogonally in spaced-apart, parallel fashion from the first and second base members 32 and 34 respectively. A reinforcing member 40, which is spaced-apart from the base plate 30, extends between the first sidewall and second sidewall engagement members 36 and 38. A front cover restraining member 42 extends orthogonally from an upper end of the first sidewall engagement member 36, and additionally a back cover restraining member 44 extends orthogonally from the second sidewall engagement member 38. The front cover restraining member 42 and back cover restraining member 44, which are spaced-apart from each other, extend inwardly, that is in substantially the same direction as the arm 20. Thus, the first hook-like restraining member 16 includes two inwardly opening spaced apart hook structures (namely the first sidewall engagement member 36 and front cover restraining member 42 as one hook structure, and the second sidewall engagement member 38 and the back cover restraining member 44 as a second hook structure).

The second hook restraining member 18 has a similar configuration to the first hook restraining member, and in this regard includes a base plate 46 having first and second spaced-apart base members 48, 50 affixed thereto. First and second sidewall engagement members 52 and 54 extend upwardly in spaced-apart parallel fashion from the elongate base members 48 and 50, respectively. A reinforcing member 60 extends between upper ends of the first and second sidewall engagement members 52 and 54. Spaced-apart, front cover restraining member 56 and a back cover restraining member 58 extend inwardly from the first and second sidewall engagement members 52, 54, respectively. A portion of the tubular sleeve 24 is rigidly connected to the base plate 30 for receiving the locking arm 20.

As can be appreciated from the illustration of FIG. 1, when the locking arm 20 is received within the tubular sleeve 24 of the lock device 22, the first and second hook restraining members, 16, 18 have opposing openings. In use, a laptop computer can be engaged between these opposed openings.

In one example embodiment, a through-hole 62 is provided through the base plate 46 in order to permit the security device 10 to be anchored to a support member 64. By way of example, a bolt 66 and nut 68 combination could be used in combination with the through hole 62 to secure the second securing member 14 to an upper surface 70 of the support member 64. In an example embodiment, the bolt 68 would be received in a recessed hole on the underside of the support member 64 in order to prevent its unauthorized removal, or alternatively the nut 68 could be located in an area of the underside support member 64 which is protected by a locked drawer or the like.

Figure 2:
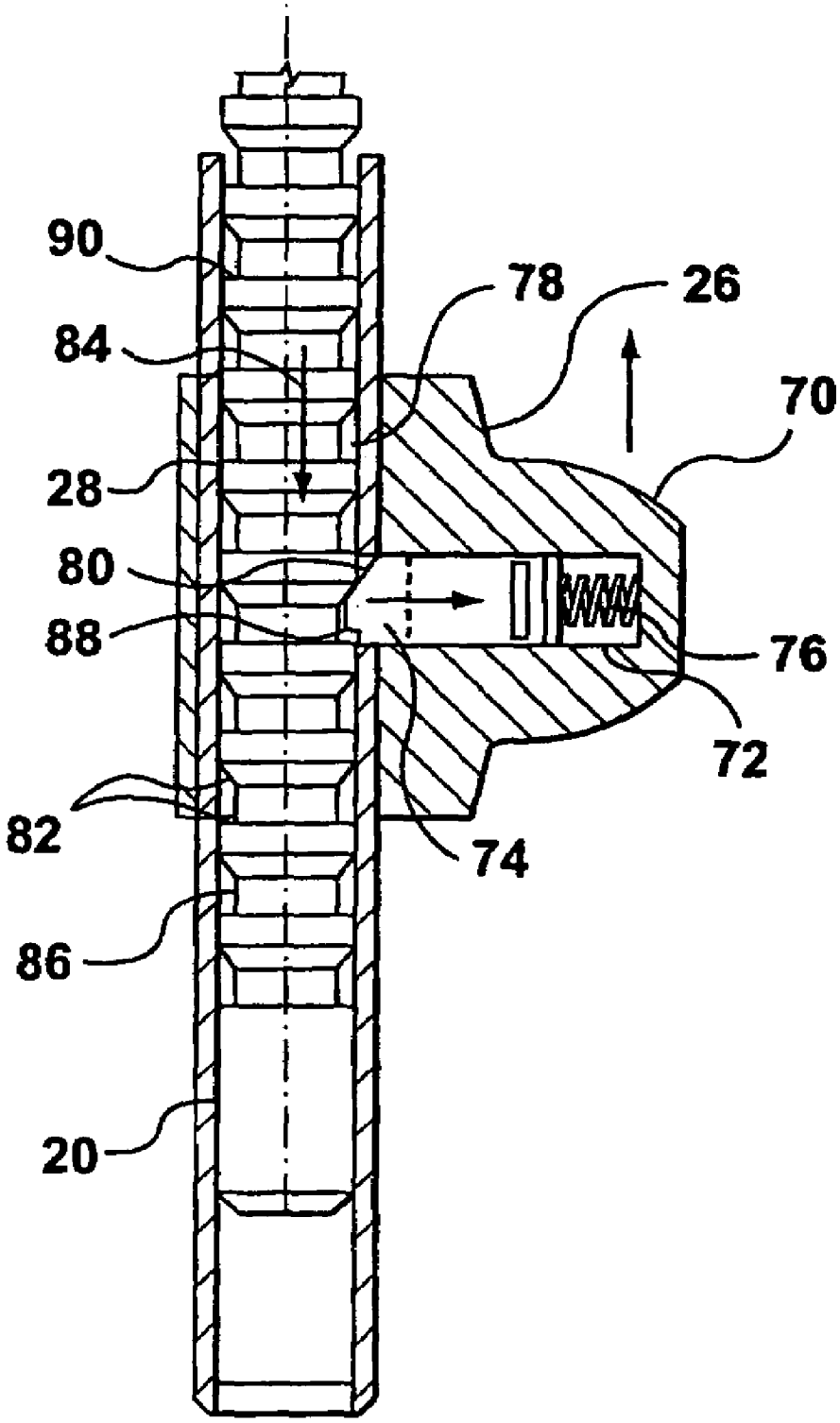
FIG. 2 a partial sectional view of a lock assembly of the security device, taken across the lines II—II of FIG. 1.

The locking assembly 26 will now be described with reference to FIG. 2. In an example embodiment of the invention, the security device uses a locking assembly 26 having a similar configuration and construction as the locking assembly described in U.S. Pat. No. 6,308,928 issued Oct. 30, 2001, to the inventor of the present invention. In this regard, the locking assembly 26 has a hardened steel housing 70 having a blind hole 72 in which is situated a spring loaded pawl 74. The spring loaded pawl 74 is normally biased into a locked position (shown in FIG. 2) under the influence of a spring 76. In this position, the spring 76 biases the pawl 74 part way into a passage way 78 of the lock assembly 26 for receiving the arm 20 therethrough.

The pawl 74 presents an inclined surface 80 for meeting a frustial conical surface 82 of the ratchet teeth 28 that are provided along the arm 20. This configuration allows the arm 20 be advanced within the passage way 78 relative to the locking device 26 in the direction of arrow 84 shown in FIG. 2. When moved in the direction of arrow 84, the pawl 74 is pushed into the blind hole 72 by each ratchet tooth 28 passing the pawl 74. As each ratchet tooth 28 passes the pawl 74, the spring 76 urges the pawl 74 back into an annular space 86 between adjacent ratchet teeth 28. When the pawl is positioned in an annual space 86, movement of the arm 20 in a direction opposite to the direction shown by arrow 84 is blocked by the engagement of transversely-extending planar surface 88 of the pawl 74 with a portion of a planar angular surface 90 of a subject ratchet tooth 28. Thus, the spring-loaded pawl 74 permits the arm 20 to be telescoped into the locking device 22 while preventing the arm 20 from being separated from the locking device 22 when it is in its locked position. In one embodiment, the lock assembly 26 is actuated by a removable key 92. In a manner known in the art, rotation of the key 92 will rotate a torque blade and displace the pawl 74 into the blind hole 72 to compress the spring 76, and away from the passage way 78, thereby unlocking the lock assembly 26 to permit withdrawal of the arm 20 from the lock device 22.

Figure 3:
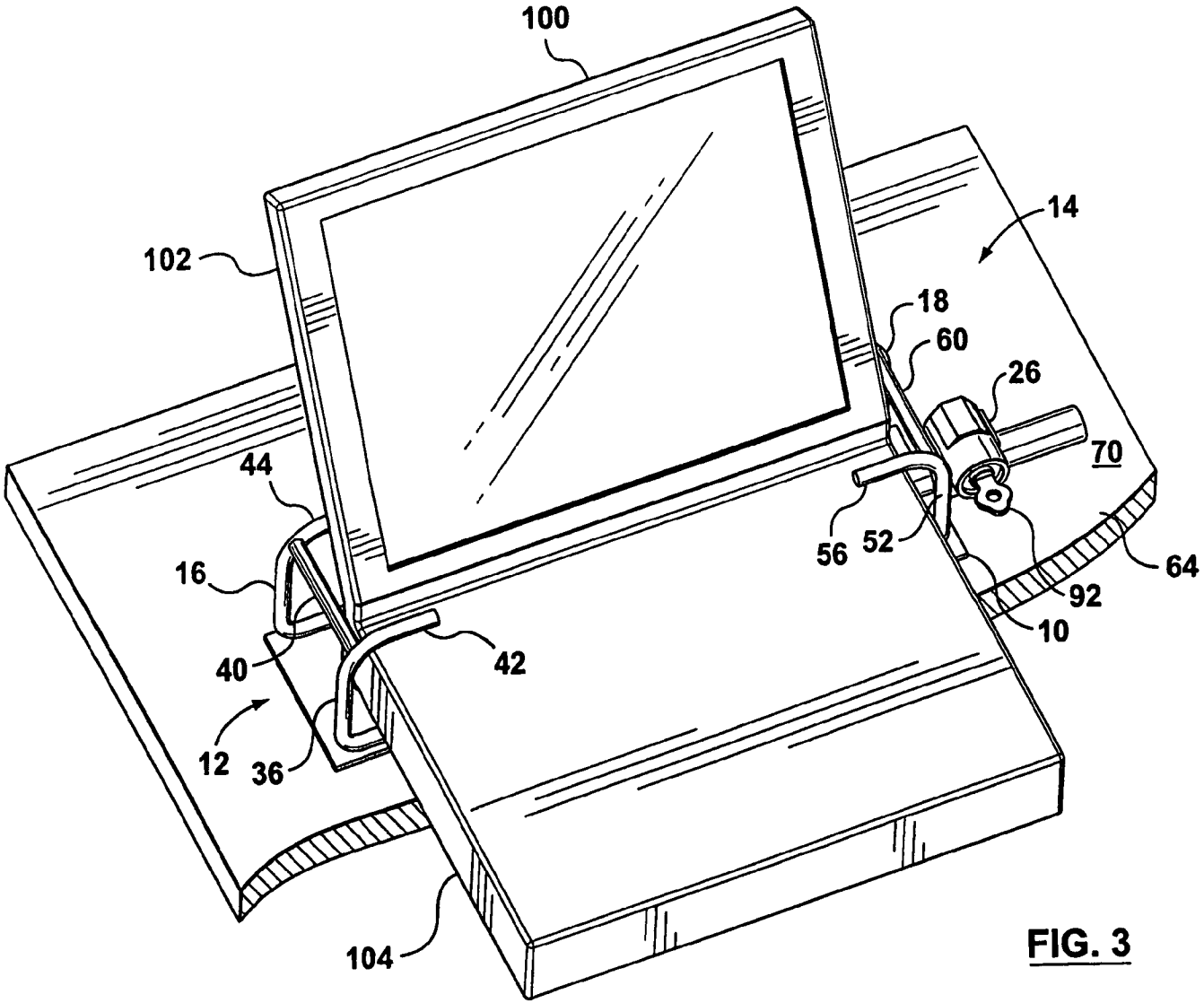
FIG. 3 is a perspective view of the security device of FIG. 1 shown in use securing a laptop computer in the opened position to a support member.

An overview of the security device 10 having been provided, an explanation of the operation of the device to secure an open laptop computer will now be explained with reference to FIGS. 1–3. With reference to FIG. 3, a laptop/notebook style computer 100 is shown secured in an opened position to the support member 64. The laptop computer 100 includes a cover 102 and a base 104 pivotally connected together for movement between an open position in which the cover extends at an angle from the base, and a closed position in which the cover and base collectively define a rectangular box-like structure. In the example illustrated in FIG. 3, the second securing member 14 has been anchored to an upper surface 70 of the support member 64 by means of a bolt 66. As can be appreciated from FIG. 3, the through hole 62 (see FIG. 1) passes through the base plate 46 of the securing member 14 in a location that is located underneath base 104 of the laptop computer when the computer is secured by the securing device 10, thus preventing access to the securing bolt 66.

As will be understood from FIGS. 1 and 3, when securing the laptop 100, the locking arm 20 extends underneath the base 104 of the laptop with its extending end is received within the sleeve 24 of lock device 22. The first securing member 12 is telescoped towards the second securing member 14 until the laptop is restrained between the first hook restraining member 16 and second hook restraining member 18 as shown in FIG. 3. In the engagement position as shown in FIG. 3, upward movement of the laptop computer is prevented by front cover restraining members 42 and 56 which engage an upper surface of the base 104 if the laptop 104 is moved in an upward direction. Front cover restraining members 42 and 56 also restrain forward movement of the laptop computer 100 by engaging a front portion of the cover 102 when the laptop is moved in a forward manner. Backward movement of the laptop computer is restrained by back cover restraining members 44 and 58 which engage back portions of the cover 102 when the laptop computer 100 is moved in a rearward direction. Sideways movement of the laptop computer is restrained by first sidewall engagement members 36 and 52 and, in the embodiment of FIG. 3, also by reinforcing members 40 and 60.

Thus, in the engagement position, the first and second opposed hook restraining members 16 and 18 prevent unauthorized removal of the laptop computer. For each of the restraining members, the respective front cover restraining members 42 and 56 and elongate base members 32 and 48 are preferably spaced far enough apart to accommodate a wide range of different laptop thicknesses (and also to accommodate closed laptops as explained in greater detail below), while at the same time not being spaced so far apart so as to allow the laptop computer to be rotated out of the security device 10. Similarly, the front cover restraining members 42, 56 are preferably spaced sufficiently far from their corresponding back cover restraining members 44, 58 to accommodate a range of laptop covers of varying thickness, and also to permit the laptop screen to be angled according to the preference of the user, while at the same time not being spaced-apart so far as to permit the laptop computer 100 to be rotated out of the security device. Rotation of the key 92 to unlock the lock assembly 26 will release the pawl 74 from the ratchet teeth 28 to permit separation of the first and second securing members in order to release the laptop computer 100.

Figure 4:
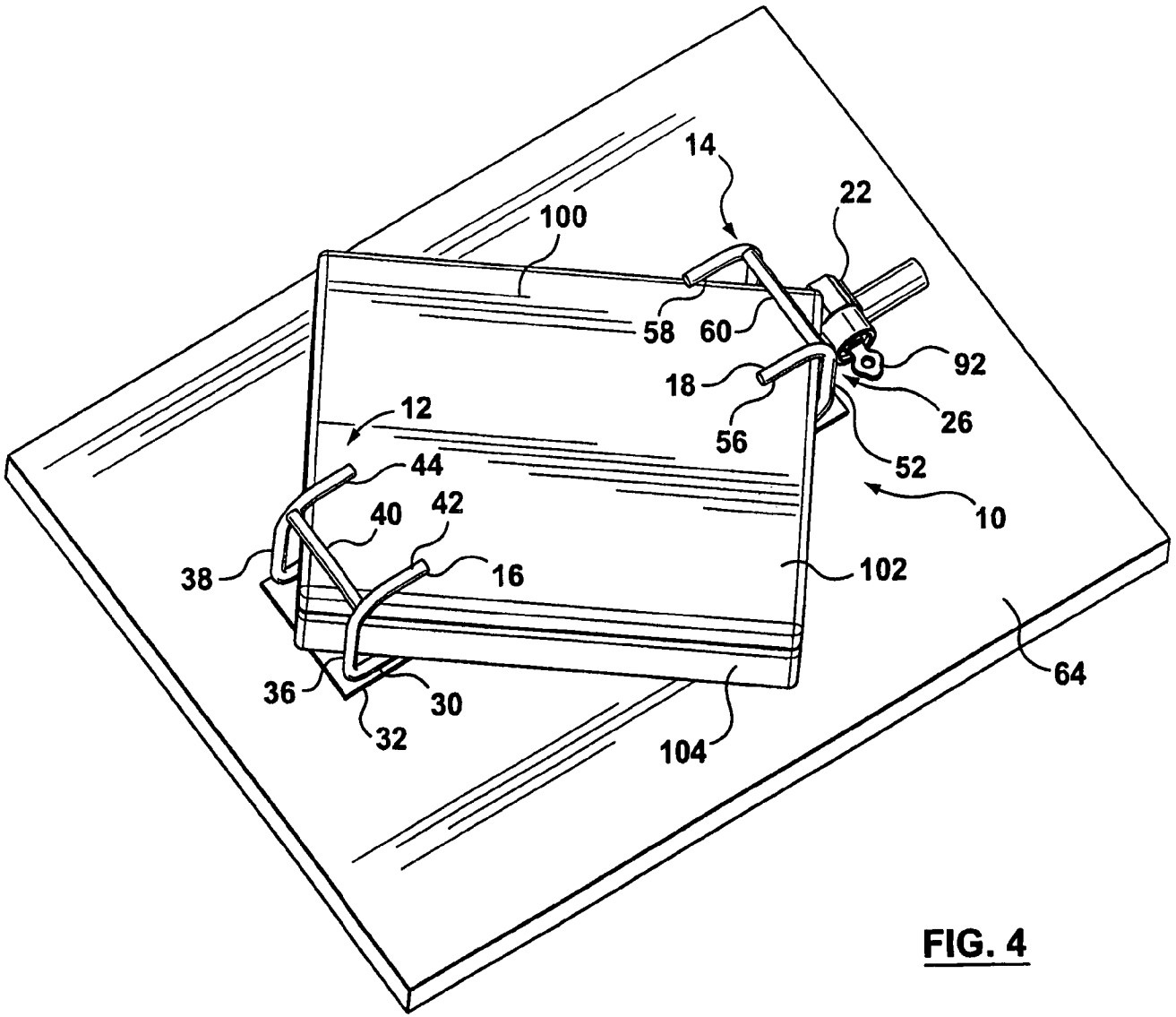
FIG. 4 is a perspective view of the security device of FIG. 1 shown in use securing a closed laptop computer to a support member.

With reference to FIG. 4, the heretofore described embodiment offers a great degree of a flexibility in that the adjustability permitted by telescopic locking arm 20, and the configuration of the first and second hook members 16 and 18, permit the security device 10 to also be used to secure a closed laptop computer 100 to the support surface of the support member 64. In FIG. 4, the first securing member 14 has been anchored to the support member 64. In the engagement position, a pair of diagonally located corners of the laptop computer 100 are secured between the opposed first and second hook members 16 and 18. With respect to first hook restraining member 16, opposed first and second sidewall engagement members 36, 38 restrain movement of the laptop computer 100 in a horizontal plane parallel to the upper surface of support member 64 by engaging a pair of the sidewalls of the closed laptop computer 100. Front cover restraining member 42, back cover restraining member 44 and reinforcing member 40 collectively function as an engagement member to prevent any substantial upward movement of the laptop computer 100, and the baseplate 30 and members 32, 34 (which are in opposed relation to the restraining member 42, back cover restraining member 44 and reinforcing member 40) function as a further engagement member to prevent movement in a downward direction. Similarly, with respect to the second hook restraining member 18, first sidewall and second sidewall engagement members 52, 54 engage another pair of sidewalls of the laptop computer 100 to prevent sideways movement of the laptop, and the front cover restraining member 56, back restraining member 58 and reinforcing members 60 are located over the cover 102 to prevent upward movement of the laptop 100.

It will be appreciated that when the security device 10 is in its engagement position securing a closed laptop computer, even if a potential thief manages to pry the security device 10 from the support member 64, the laptop computer 100 will still effectively be locked in the closed position. In some environments, the security device may be used to maintain a laptop computer in a closed position without anchoring the device to a support member 64 by means of bolt 66.

It will thus be appreciated that the present invention provides a flexible security device which can conveniently and easily be used to lock clam-shell style laptop computers, both in an opened and closed position, and of varying sizes and styles, to a support member. It will be appreciated that the device could also be configured to be used to secure other equipment components that have diagonally opposed corners, such as a tool box for example.

Many variations and different embodiments of the present invention are possible. For example, in some applications the reinforcing members 40 and 60 may not be required. A non-exclusive list of examples of other possible modifications is as follows. Although bolt 66 passing through a through hole 62 has been described as one means for securing the security device 10 to a support member 64, other anchoring methods could be used. For example the through hole 62 could pass through the base plate 30 (or be provided in some other manner) of the first securing member 12, rather than the base plate 46 of the second securing member 14. In some embodiments, an adhesive may be used to secure the security device to a support member. In some embodiments a cable may be used. In other embodiments, the bolt 66 could be replaced with a shaft that could receive some sort of locking device, for example a pad lock on a lower end thereof. One of the first or second securing members 12, 14 could include a downwardly extending shaft with ratchet teeth on it for mounting to a desk top in a manner similar to that shown in aforementioned U.S. Pat. No. 6,308,928 to Galant. Accordingly, it will be appreciated that numerous different anchoring systems can be used to anchor the device of the present invention to a support member 64 or other structures.

Although a key actuated lock assembly 26 has been shown in the Figures, different types of lock assemblies could be used such as a combination actuated lock in place of a key actuated lock. Furthermore, a number of different types of pawl and ratchet configurations could be used, and in some embodiments less sophisticated locking methods could be used, for example through-holes could be provided along the length of the arm 20 for receiving a pad lock passed through corresponding locking holes provided in the sleeve 24. Although the locking arm 20 and sleeve 24 have been shown as cylindrical, different telescoping configurations could be used.

Figure 5:
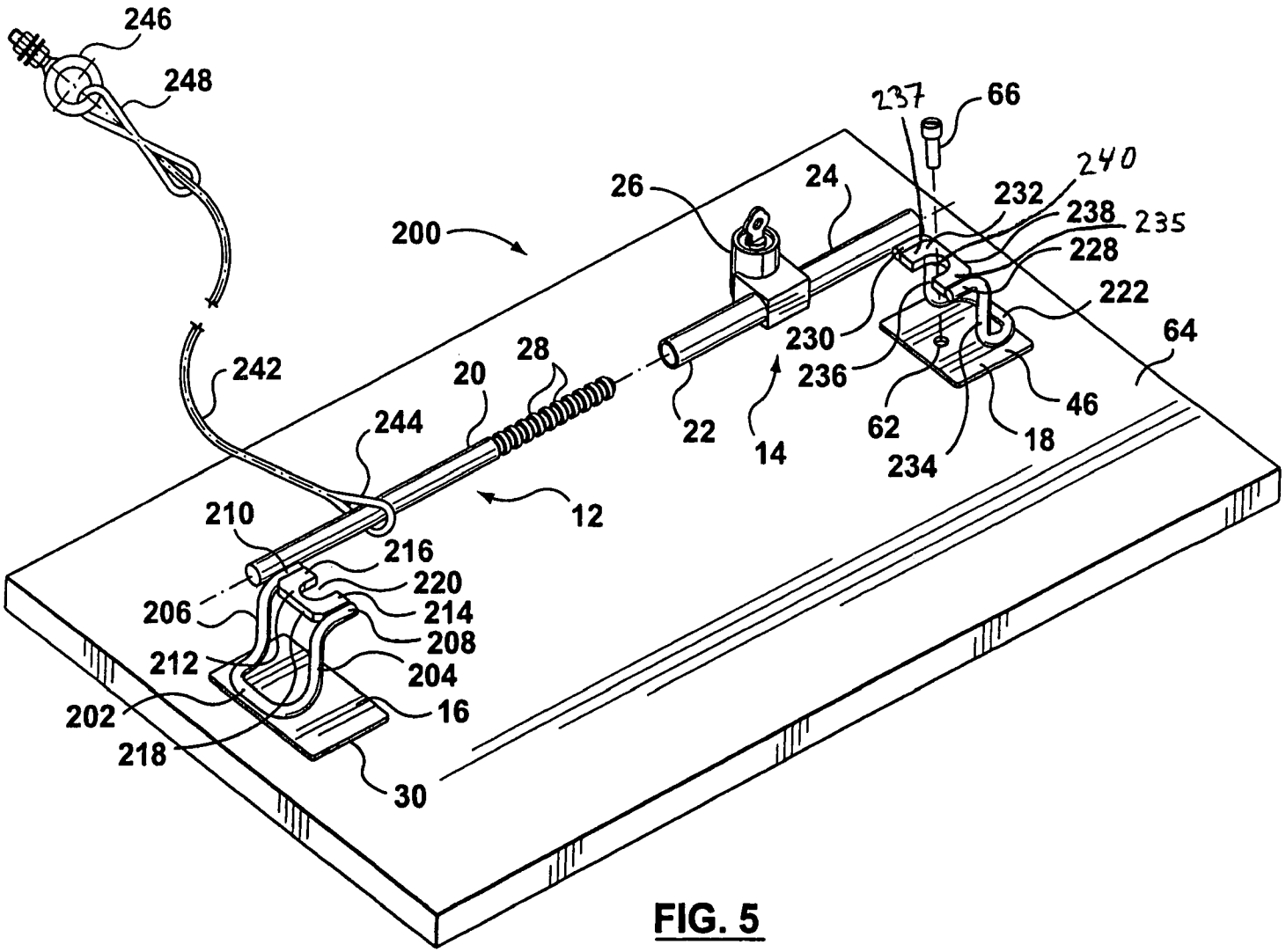
FIG. 5 is a perspective view of a security device in accordance with a further example embodiment of the invention.

With reference to FIG. 5, a security device in accordance with further example embodiments of the invention is indicated by general reference number 200. The security device 200, although similar to the security device 10, differs from the security device 10 in respects that will be apparent from the drawings of the respective devices and the following description. As with device 10, the security device 200 includes first and second securing members 12 and 14 which can be telescopically connected together to secure a piece of equipment such as a laptop computer therebetween, the first securing member 12 including a first hook-like restraining member 16, and the second securing member 14 including a second hook-like restraining member 18 in opposed relationship with the first restraining member 16.

In the illustrated embodiment, the first hook member 16 is made up of a base plate 30. A U-shaped tubular base member 202 is rigidly secured to the base plate 30. Spaced-apart first and second sidewall engagement members 204 and 206 extend upward from the ends of base member 202, and first and second spaced-apart arms 208, 210 extend inwardly from upper ends of the engagement members 204 and 206, respectively. A U-shaped plate 212 is positioned between members 208 and 210. The U-shaped plate 212 includes spaced apart front and back restraining members 214,216 that are joined at their outer ends by a side restraining member 218, the members 214,216 and 218 collectively defining an inward opening 220 in which the edge of a laptop computer cover 102 can be received.

The second hook restraining member 18 has a similar configuration to the first hook restraining member, and in this regard includes a base plate 46 having secured thereto a U-shaped tubular base member 222. Spaced-apart first and second sidewall engagement members 234 and 236 extend upward from the ends of base member 222, and first and second spaced-apart arms 228, 230 extend inwardly from upper ends of the engagement members 234 and 236, respectively. A U-shaped plate. 232 is positioned between members 228 and 230. The U-shaped plate 232 includes spaced apart front and back restraining members 235, 237 that are joined at their outer ends by a side restraining member 238, the members 235, 237 and 238 collectively defining an inward opening 240, in opposed relation to opening 220, in which a further edge of a laptop computer cover 102 can be received.

As with security device 10, the security device 200 includes an elongate cylindrical rod or arm 20 that extends from the first securing member 12 in the same direction that the first hook member 16 opens towards. Unlike device 10, the arm 20 of device 200 is spaced apart from the base-plate 30, and is secured to the arm 210.

The second securing member 14 includes a lock device 22 which is configured to telescopically receive the locking arm 20 of the first securing member 12. As with security device 10, the lock device 22 includes a tubular sleeve 24 which has a lock assembly 26 mounted thereon for engaging ratchet teeth 28 that are provided along the length of an extending portion of the arm 20. The tubular sleeve 24 of the security device 200 is spaced apart from the base plate 46 and is rigidly secured to the arm 230 of the restraining member 18.

When the locking arm 20 of the security device 200 is received within the tubular sleeve 24 of the lock device 22, the first and second hook restraining members, 16, 18 have opposing openings. In use, a laptop computer can be received between these opposed openings. Similar to security device 10, the security device 200 can be anchored to a support member 64 by means of bolt 66 passing through hole 62 that is provided through the base plate 46.

In addition to or in place of a bolt passing through hole 62, a cable 242 could be used to secure the security device 200 (or security device 10 or any of the other embodiments of the security device that are described further below) to a structure. In the embodiment illustrated in FIG. 5, the cable 242 is secured at one end to the security device 200 by means of a loop 244 through which the arm 20 or sleeve 24 is threaded through. The loop 244 is small enough so that it can not be slipped over the opposed restraining members 16 or 18. An eye bolt and nut combination 246 can be used to secure the other end of the cable 242 to a structure to prevent unauthorized removal of the security device and the piece of equipment that is engaged by the security device. A second loop 248 on the cable 242 can also be threaded through the arm 20 or sleeve 24 so that security device 200 can be secured in place by passing the cable 242 through a hole or opening in a structure and inserting the arm 20 or sleeve 24 through both loops 244, 248. Such a cable configuration could conveniently be used to secure a laptop computer (or other rectangular-type equipment) to a car part within the car cabin or a car trunk, for example.

Figure 6:
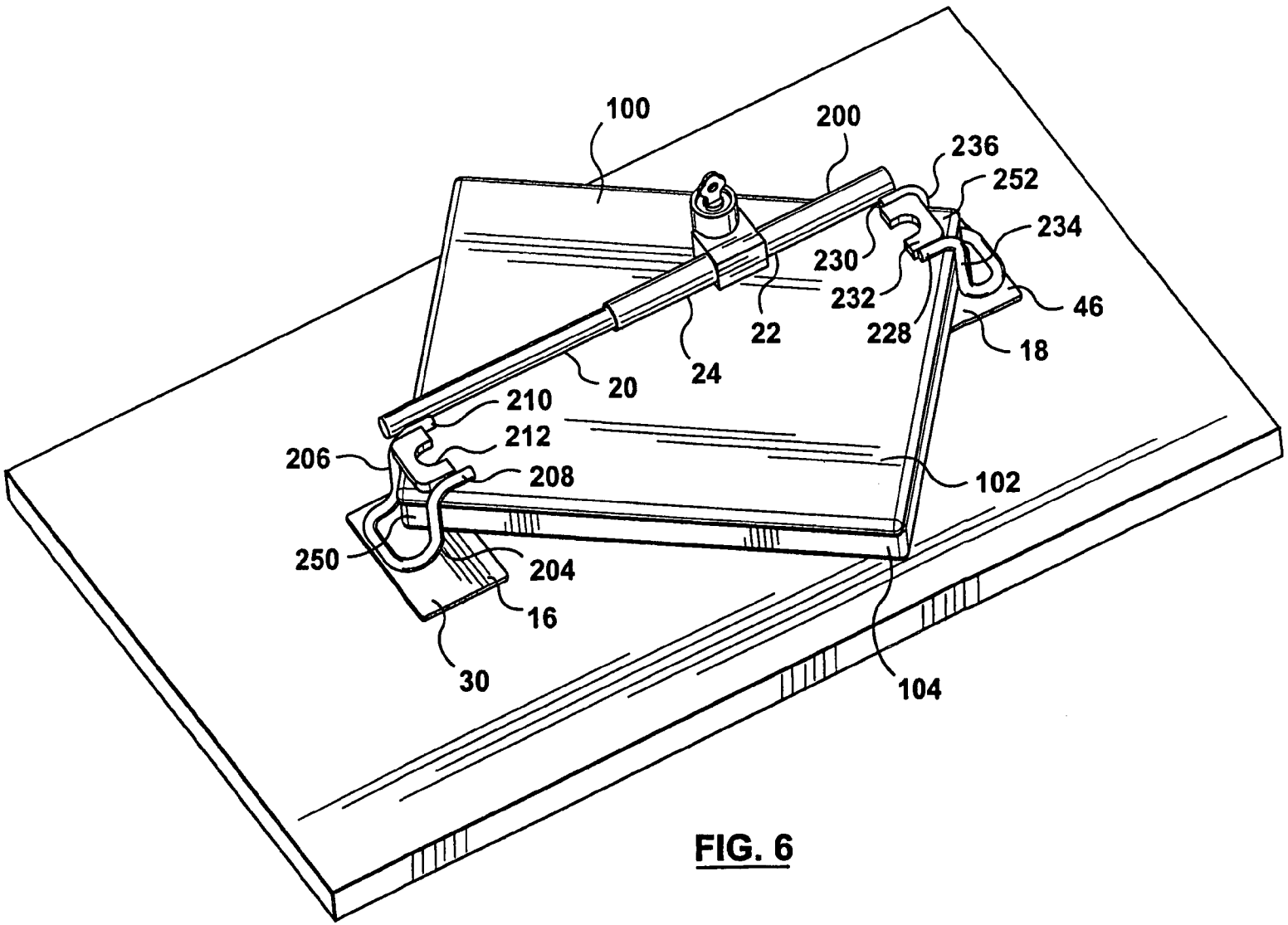
FIG. 6 is a perspective view of the security device of FIG. 5 shown in use securing a laptop computer in the closed position to a support member.

FIG. 6 shows the security device 200 securing closed laptop computer 100 by engaging the diagonally opposite corner portions 250 and 252 of the laptop computer 100. The first restraining member 16 includes portions that engage all four walls that meet at one corner portion 250 of the laptop computer. In particular, sidewall engagement members 204 and 206 function as opposing members and each engage one of the sidewalls that meet at 90 degrees at the corner 250. The base plate 30 is in opposed relation to the arms 208, 210 and U-shaped plate 212 with the base plate engaging the bottom wall of the laptop at corner 250, and the arms 208, 210 and U-shaped plate 212 engaging the top cover wall of the laptop at corner 250. Depending on the computer height, the space between the base pate 16 and the U-shaped plate 212 may be larger than the height of the closed laptop, and accordingly there may be some limited movement of the laptop possible relative to the security device 200. The second restraining member 18 engages the diagonally opposite corner 252 in a similar manner. In FIG. 6, the arm 20 and sleeve 24 pass over the top of the laptop cover rather than under it as shown in the embodiment of FIG. 4.

Figure 7:
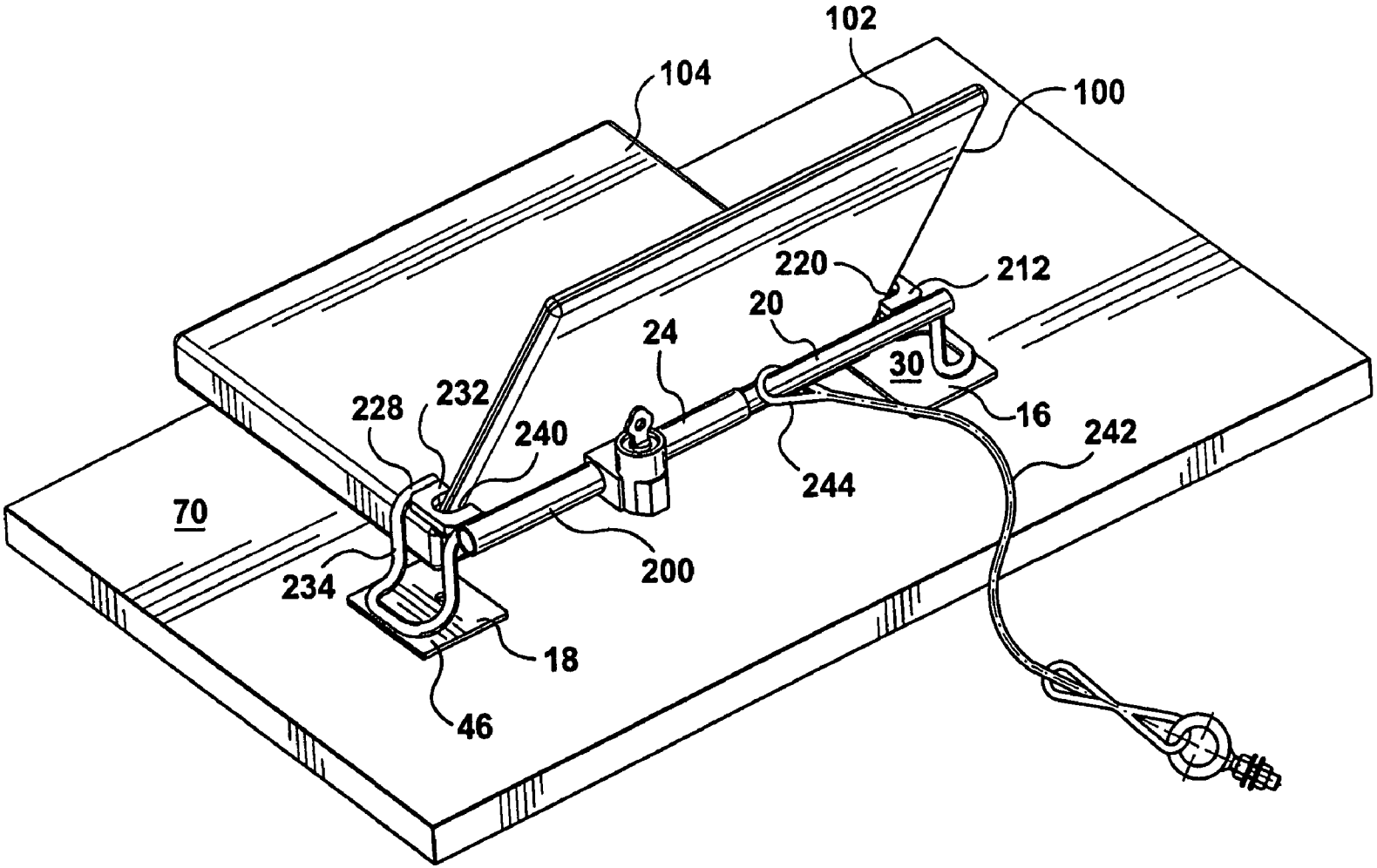
FIG. 7 is a perspective view of the security device of FIG. 5 shown in use securing an open laptop computer to a support member.

FIG. 7 shows the security device 200 securing laptop computer 100 in an open position. Opposite side edge portions of the open cover 102 are received and restrained within the opposed openings 220 and 240 that are defined by U-shaped plates 212 and 232, respectively, and opposite side edge portions of the base 104 are received within the opposed openings defined by baseplate 46, sidewall engagement member 234 and arm 228 of the restraining member 18 and baseplate 30, sidewall engagement member 204 and arm 208 of the restraining member 16. As can be appreciated from FIG. 7, the locking arm 20 and sleeve 24 are located behind the open cover 102, rather than under the computer as in the embodiment of FIG. 3, and thus the security device 200 does not require that the computer base 204 sit at an angle relative to the support surface 70. Furthermore, as the locking arm 20 does not pass under the laptop, the lock assembly 26 can be positioned between the first and second restraining members 16 and 18, thus making the security device 200 have an overall relative length that is shorter than that of device 10 in which the lock assembly is located outside of the second restraining member 18.

Figure 8:
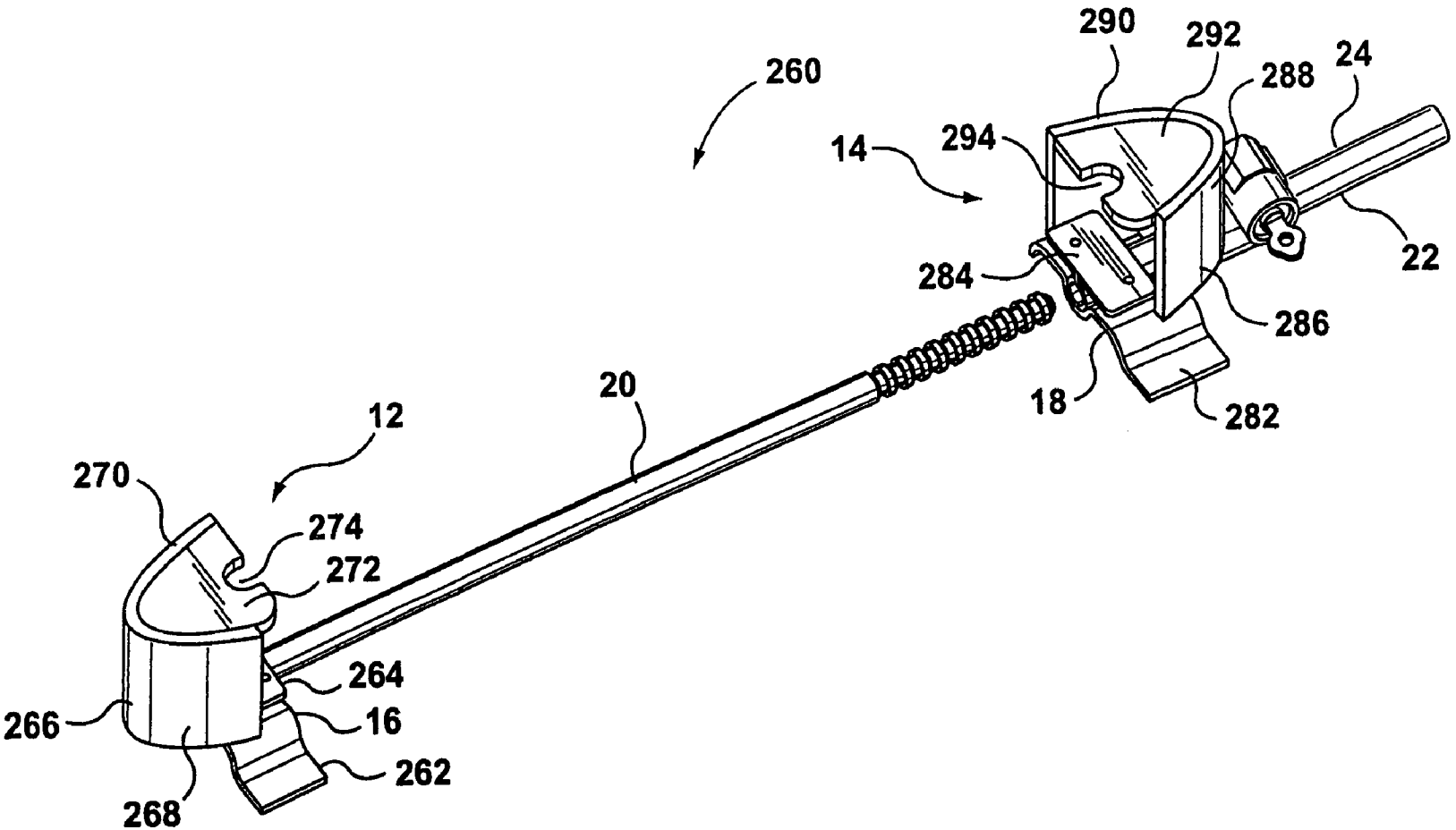
FIG. 8 is a perspective view of another security device in accordance with a further example embodiment of the invention.

With reference to FIG. 8, another security device in accordance with further example embodiments of the invention is indicated by general reference number 260. The security device 260, although similar to the security device 10, differs from the security device 10 in respects that will be apparent from the drawings of the respective devices and the following description. As with device 10, the security device 260 includes first and second securing members 12 and 14 which can be telescopically connected together to secure a piece of equipment such as a laptop computer therebetween, the first securing member 12 including first restraining member 16, and the second securing member 14 including second restraining member 18 in opposed relationship with the first restraining member 16.

In the illustrated embodiment of FIG. 8 hook member 16 of device 260 is made up of a base plate 262, from which locking arm 20 extends. An optional shim plate 264 is positioned on the base plate 262. An inwardly opening (i.e. towards a center of the security device 260) U-shaped wall 266 extends upward from the baseplate 262 having opposed wall portions 268, 270 that have approximately orthogonal sections for engaging the orthogonal sidewalls of a closed laptop. A U-shaped plate 272 defining an inward facing opening 274 is located at an upper end of U-shaped wall 266 in spaced apart and opposed relation to the shim plate 264.

The second hook restraining member 18 of device 260 has a similar configuration to the first hook restraining member, and in this regard includes a base plate 282, to which locking device 22 (including sleeve 24) is attached for receiving the locking arm 20. An optional shim plate 284 is positioned on the base plate 282. An inwardly opening (i.e. towards a center of the security device 260) U-shaped wall 286 extends upward from the baseplate 282 having opposed wall portions 288, 290 that have approximately orthogonal sections for engaging the orthogonal sidewalls of a closed laptop. A U-shaped plate 292 defining an inward facing opening 294 is located at an upper end of U-shaped wall 266 in spaced apart and opposed relation to the shim plate 264.

In a manner similar to security devices 10 and 200, the device 260 can secure a laptop computer in both the open and shut positions. In the shut position, diagonally opposite corner portions of the laptop computer are received within and restrained by the restraining members 16 and 18. In particular, the laptop computer sidewalls meeting at one corner are engaged by the opposed sidewall portions 268 and 270 of restraining member 16, with the upper cover and bottom base walls at such corner portion being located between and restrained by the opposed shim plate 264 and U-shaped plate 272. The retraining member 18 engages the diagonally opposed corner in a similar manner.

In the laptop open position, the device 260 receives opposite side edges of the laptop cover within openings 274 and 294, and opposite side edges of the laptop base within the space between the shim plate 264 and U-shaped plate 272 at one edge and the shim plate 284 and U-shaped plate 292 at the opposite edge.

Figure 9:
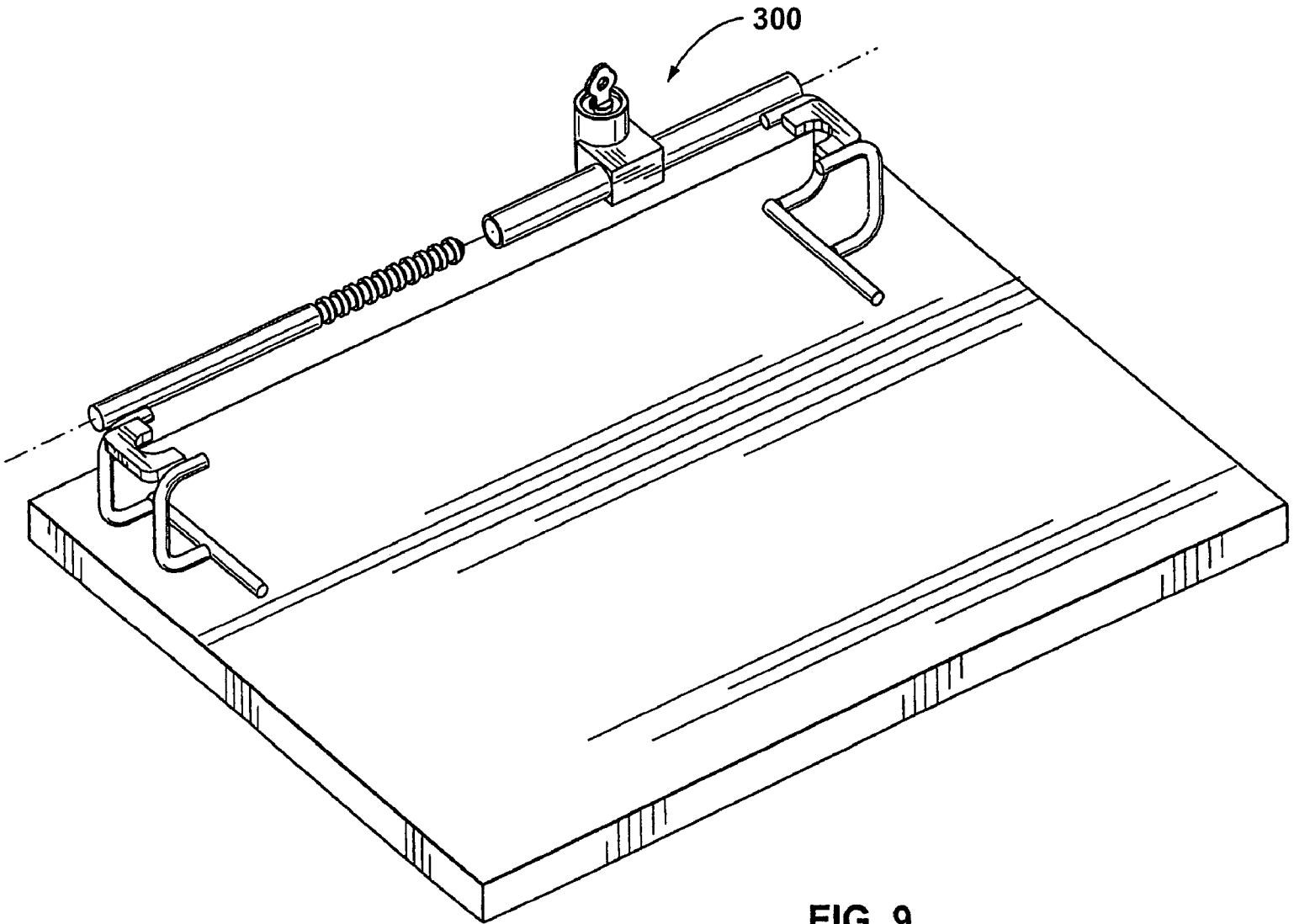
FIG. 9 is a perspective view of a another security device in accordance with a further example embodiment of the invention.

With reference to FIG. 9, yet another security device in accordance with further example embodiments of the invention is indicated by general reference number 300. The security device 300 operates in a manner similar to the security devices 10 and 260, and in particular security device 200, described above 260, except for differences, that in view of the above description, will be apparent from the respective Figures.

Figure 10:
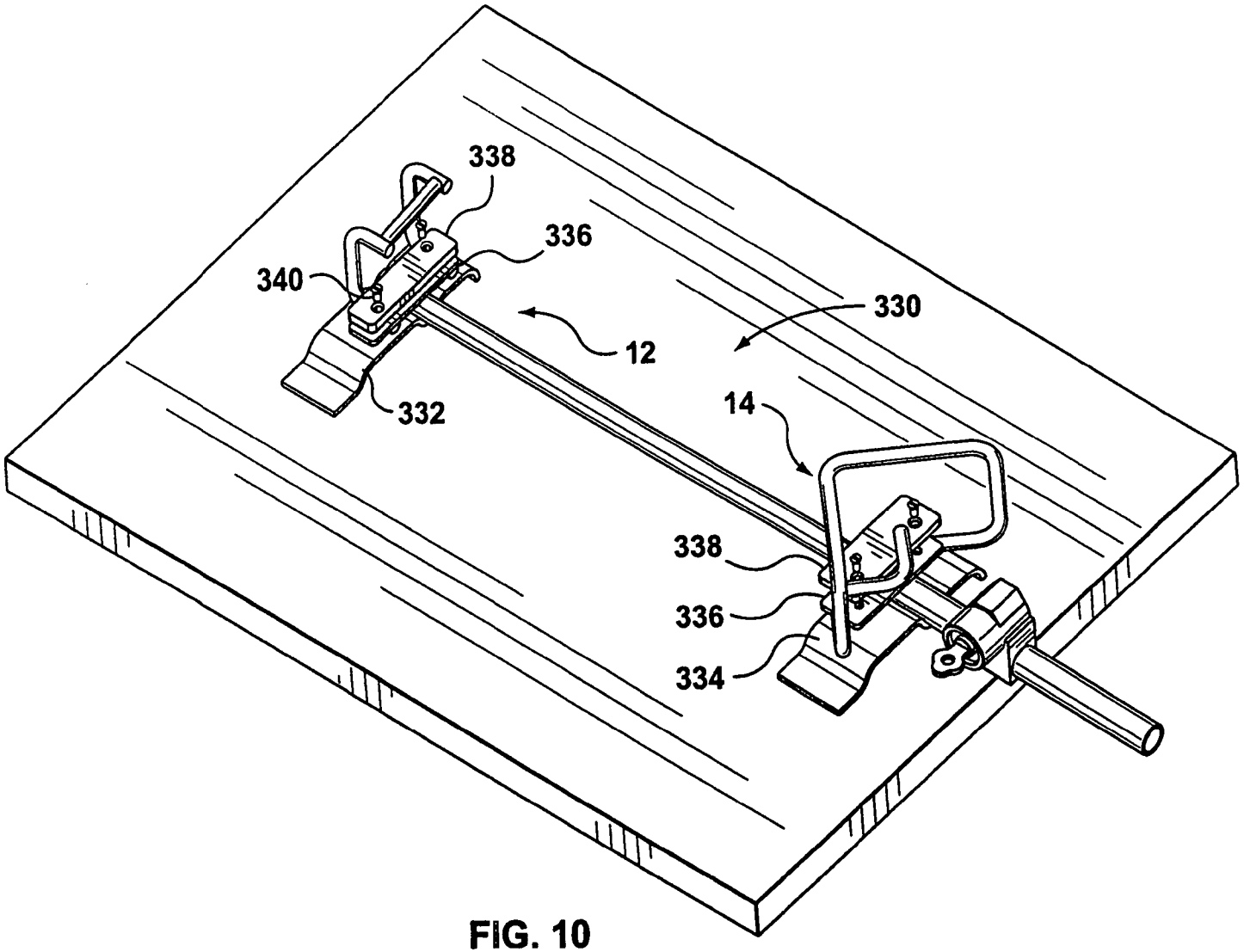
FIG. 10 is a perspective view of a security device in accordance with a further example embodiment of the invention.
Figure 11:
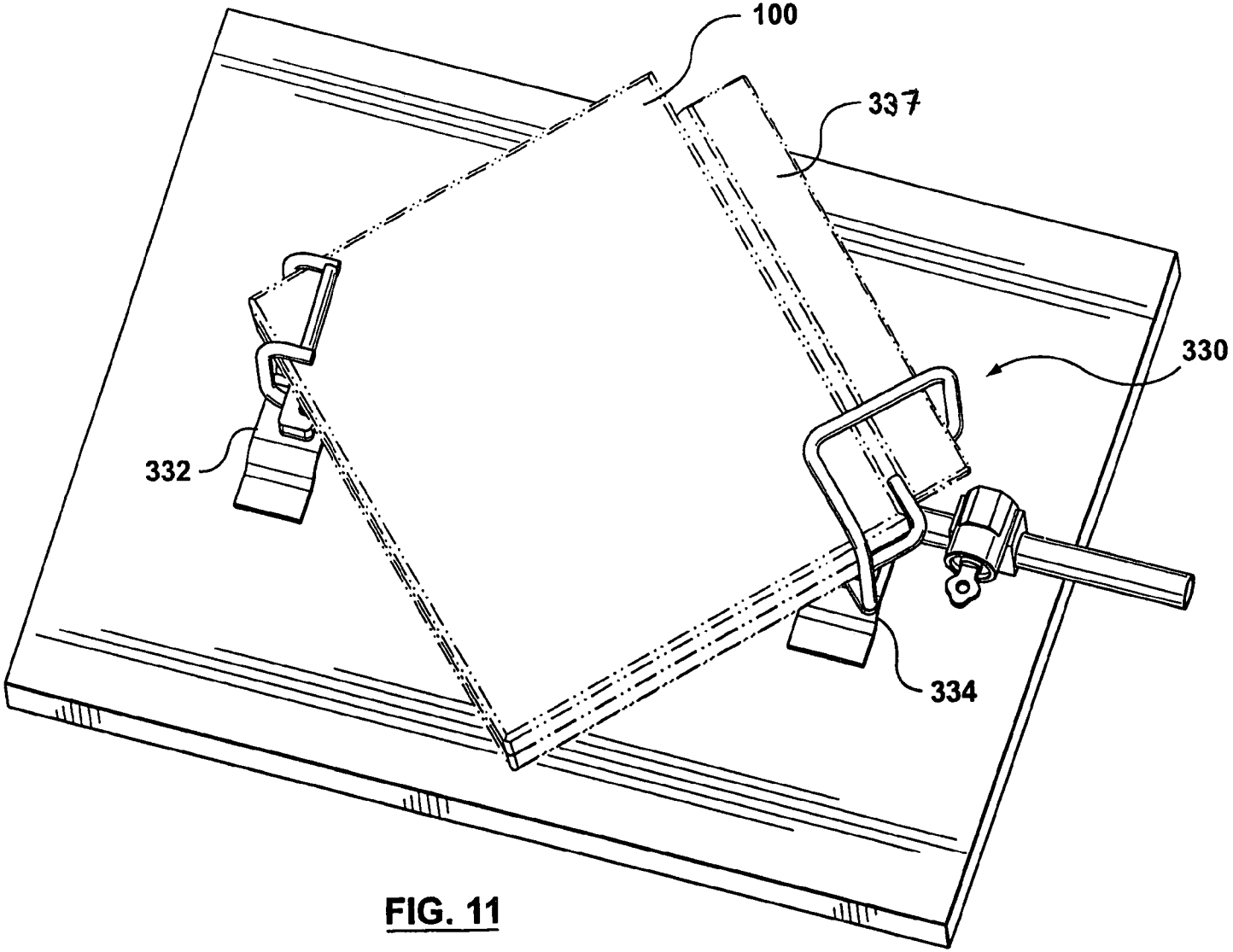
FIG. 11 is a further perspective view of the security device of FIG. 10 in use securing a closed laptop computer and docking station.

In some embodiments, the security device may be configured to permit only closed equipment components to be secured, and may be configured to secure equipment components that have opposite corner portions, but which are not perfectly square or rectangular in shape. In this regard, FIGS. 10 and 11 show an example of a further security device, indicated generally by reference 330, in accordance with example embodiments of the present invention. The security device 330 operates in a similar to the devices described above, having first and second securing members 12 and 14 that can be telescopically locked together, with opposed restraining members 332 and 334 for engaging opposite corners on a component. As will be apparent from the drawings, the security device 330, however, is not configured for use with an open laptop computer, but is configured to be used to secure a closed laptop computer 100 that is attached to a docking station 337.

As shown in FIG. 10, the security device 330 may be provided with adjustable shim plates for adjusting for computer components of different thicknesses or heights. In this respect, each of the restraining members 332, 334 has a base shim plate 336 to which can be added one or more additional shim plates 338. In the illustrated embodiment, threaded holes are provided on the base shim plates 336 for receiving screws 340 that secure the additional shim plates 338 in place. Such adjustable shim plates could also be used on the other embodiments of the security device described above to provide adjustability for a range of computer sizes.

Figure 12:
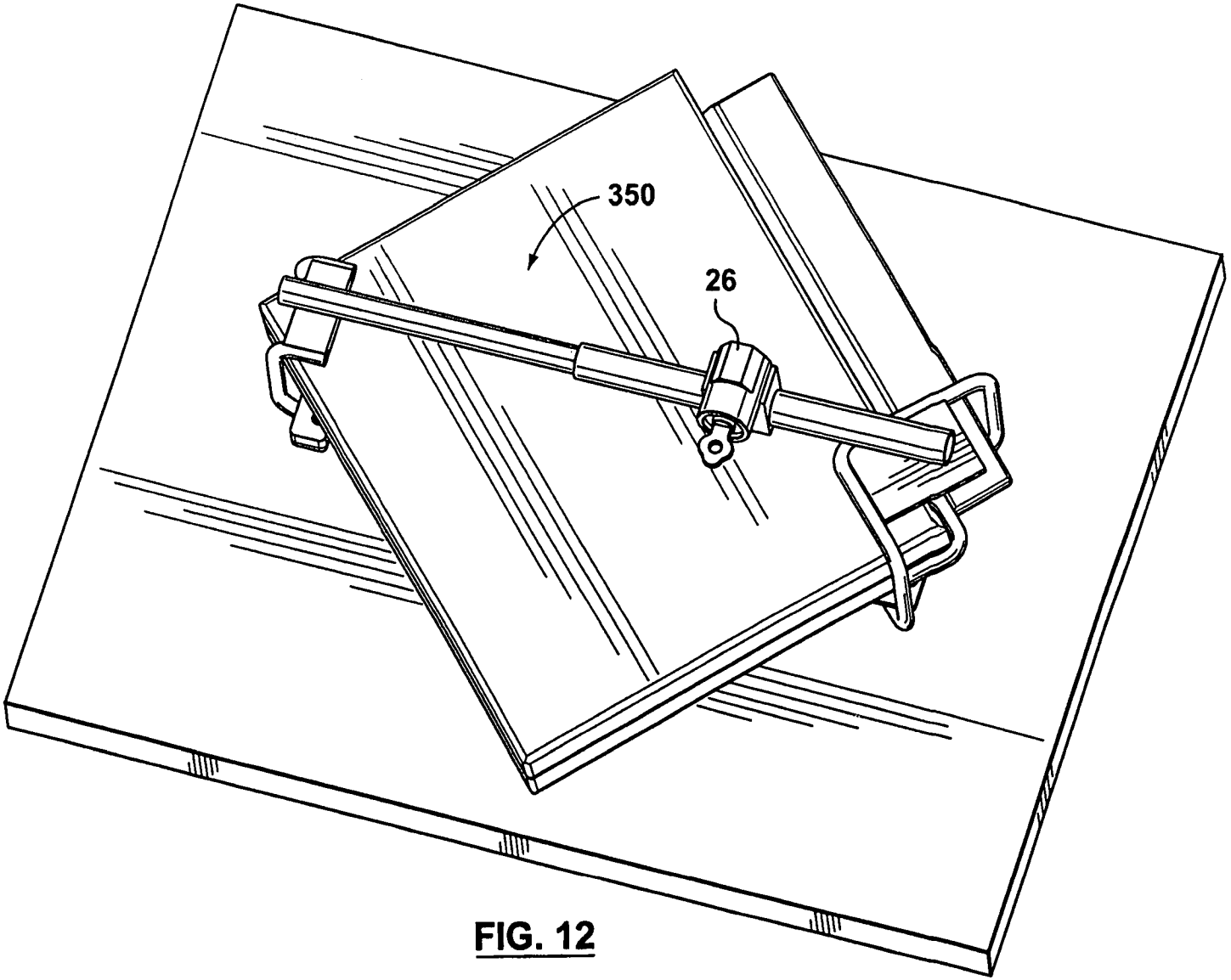
FIG. 12 is a perspective view of a security device in accordance with a further example embodiment of the invention.

FIG. 12 shows yet a further security device, indicated generally by reference 350, for securing a closed docked laptop in accordance with the present invention. The device 350 is similar to device 330, except that the locking arm and corresponding sleeve are located to pass over the top of the computer and docking station, rather than under it, which permits the device 350 to have a shorter overall profile as locking assembly 26 can be located between the opposed restraining members.

In some embodiments, the security device may be configured to secure a laptop only in the open position. For example, with reference to FIGS. 5 and 7, front side-wall engagement members 204 and 234 could be omitted without affecting the ability of device 200 to secure the laptop 100 in the open position.

Figure 13:
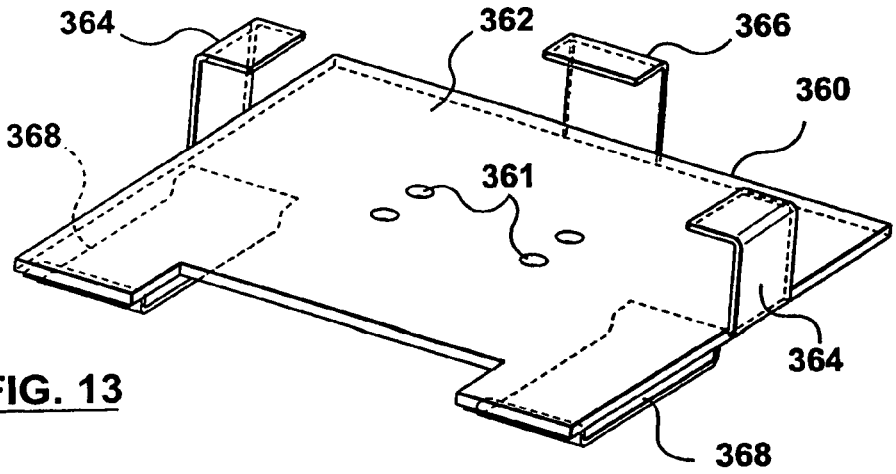
FIG. 13 is a perspective view of a mounting plate that can be used with a security device according to embodiments of the present invention.
Figure 14:
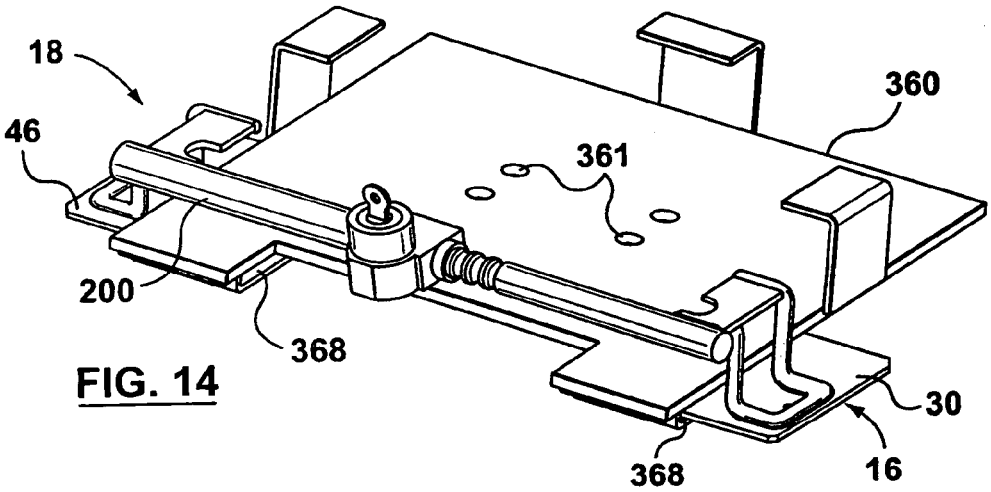
FIG. 14 is a perspective view showing the mounting plate of FIG. 13 with the security device of FIG. 5 mounted thereto.
Figure 15:
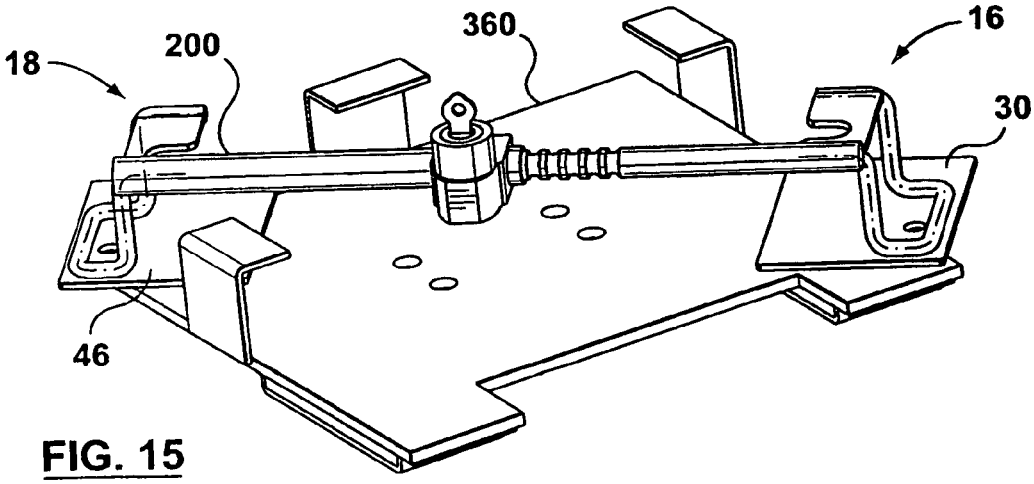
FIG. 15 is a further perspective view of the mounting plate of FIG. 13 with the security device of FIG. 5 mounted thereto.

In some embodiments, the security device could be used with a mounting plate so that a laptop computer could be secured to a pedestal mount in a mobile office such as a vehicle, for example. In this regard, FIGS. 13–15 show a mounting plate 360 that can be used with security device 200 for securing either a closed or open laptop to a conventional laptop pedestal (not shown) in a vehicle or elsewhere. The mounting plate 360 includes a substantially planar rectangular base 362 through which holes 361 for mounting bolts (not shown) can pass. Opposed L-shaped brackets 364 are provided on opposite side edges of base 362, and a further L-shaped bracket 366 is provided along a further edge of the of base 362. Outwardly opening opposed pockets 368 are provided along the same edges that opposed brackets 364 are located on. As can be see in FIG. 14, opposed pockets 368 are configured to receive the base members 30 and 46 of the opposed restraining members 16 and 18 of security device 200, such that a laptop computer (not shown) in the open position can be secured to the mounting plate 360, with the L-shaped brackets 364 and 366 engaging three of the sidewalls of the laptop and extending over edge portions of the keyboard surface, and the security device 200 engaging opposite side of the open laptop display. Bolt holes 361 will be covered by the laptop.

FIG. 15 shows the security device extending across diagonal corners of the mounting plate 360 in a position useful for securing a closed laptop computer (not shown). The base members 30, 46 of the retraining members 16, 18 may be received in pockets on opposite corners of the base plate 362, or could pass underneath the base plate 362, or one of them could be bolted to base plate 362.

Figure 16:
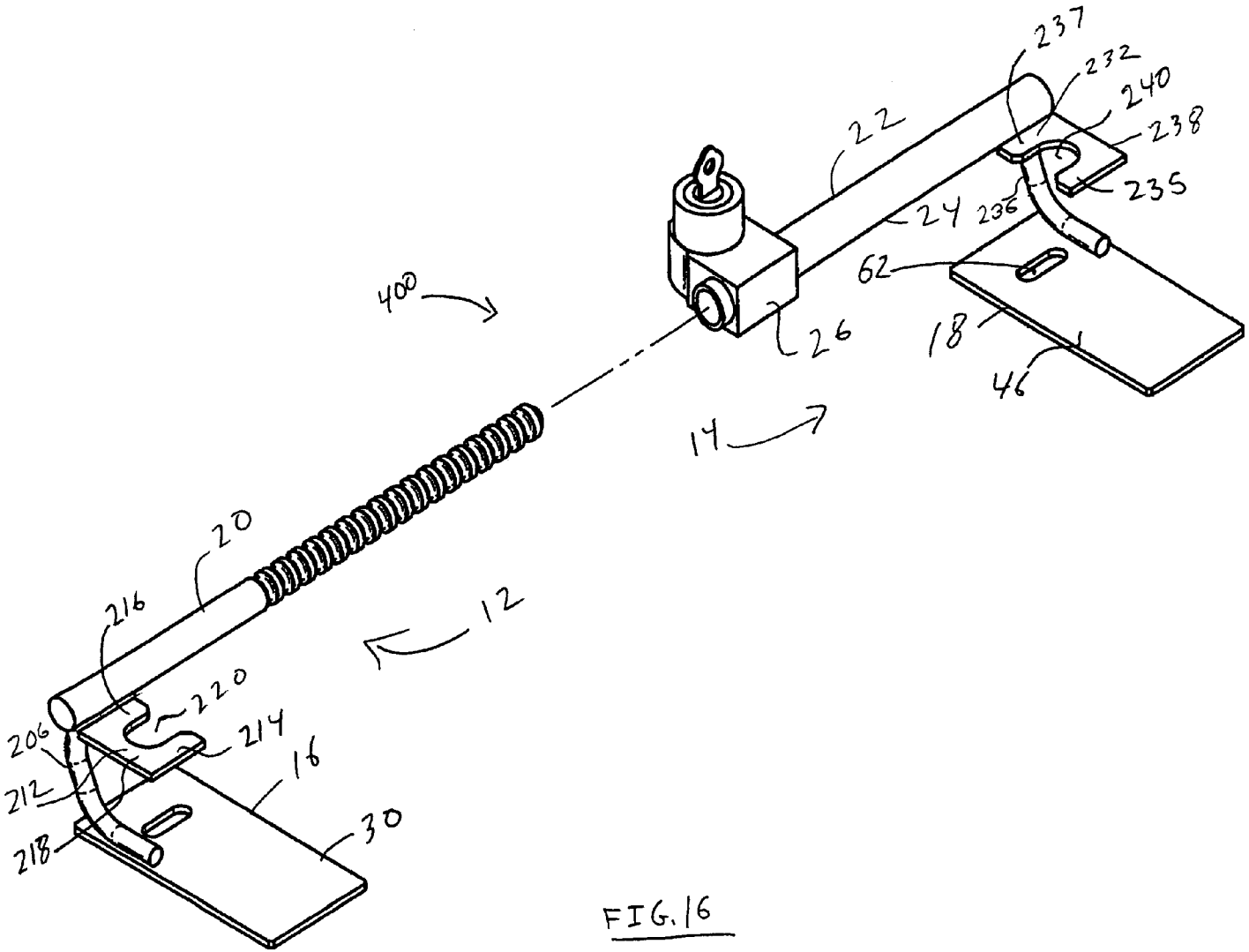
FIG. 16 is a perspective view of a security device in accordance with a further example embodiment of the invention.

As indicated above, in some example embodiments the security device could be configured to secure only open laptop computers, and in this regard FIG. 16 shows yet another example embodiment of a security device 400 that is similar to security device 200 but for differences that will be apparent from the description and Figures.

As with device 200, the security device 400 includes first and second securing members 12 and 14 which can be telescopically connected together to secure a laptop computer therebetween, the first securing member 12 including first restraining member 16, and the second securing member 14 including second restraining member 18 in opposed relationship with the first restraining member 16. The first restraining member 16 includes spaced apart base plate 30 and U-shaped plate 212. Member 206 connects plate 212 and base plate 30. The generally U-shaped plate 212 includes spaced apart front and back restraining members 214, 216 that are joined at their outer ends by a side restraining member 218, the members 214, 216 and 218 collectively defining an inward opening 220 in which the edge of a laptop computer cover 102 can be received. The second restraining member 18 has a similar configuration to the first restraining member 16, and in this regard includes a spaced apart base plate 46 and U-shaped plate 232. Member 236 connects plate 212 and base plate 30. The generally U-shaped plate 232 includes spaced apart front and back restraining members 235, 237 that are joined at their outer ends by a side restraining member 238, the members 235, 237 and 238 collectively defining an inward opening 240, in opposed relation to opening 220, in which a further edge of a laptop computer cover 102 can be received.

The security device 400 includes an elongate cylindrical rod or arm 20 that extends from the first securing member 12 in the same direction that the first restraining member 16 opens towards. The arm 20 of device 400 is spaced apart from the base-plate 30, and is secured to an upper end of member 206 and/or in some embodiments the plate 212. The second securing member 14 includes a lock device 22 which is configured to telescopically receive the locking arm 20 of the first securing member 12. The lock device 22 includes a tubular sleeve 24 which has a lock assembly 26 mounted thereon for engaging ratchet teeth that are provided along arm 20. The tubular sleeve 24 of the security device 400 is spaced apart from the base plate 46 and is rigidly secured to an upper end area of member 236, and/or in some embodiments the plate 232. The security device 400 can be anchored to a support member by means of bolt 66 passing through hole 62 that is provided through the base plate 46.

In addition to or in place of a bolt passing through hole 62, as described above, a cable 242 (see FIG. 5) could be used to secure the security device 400 to a structure.

Figure 17:
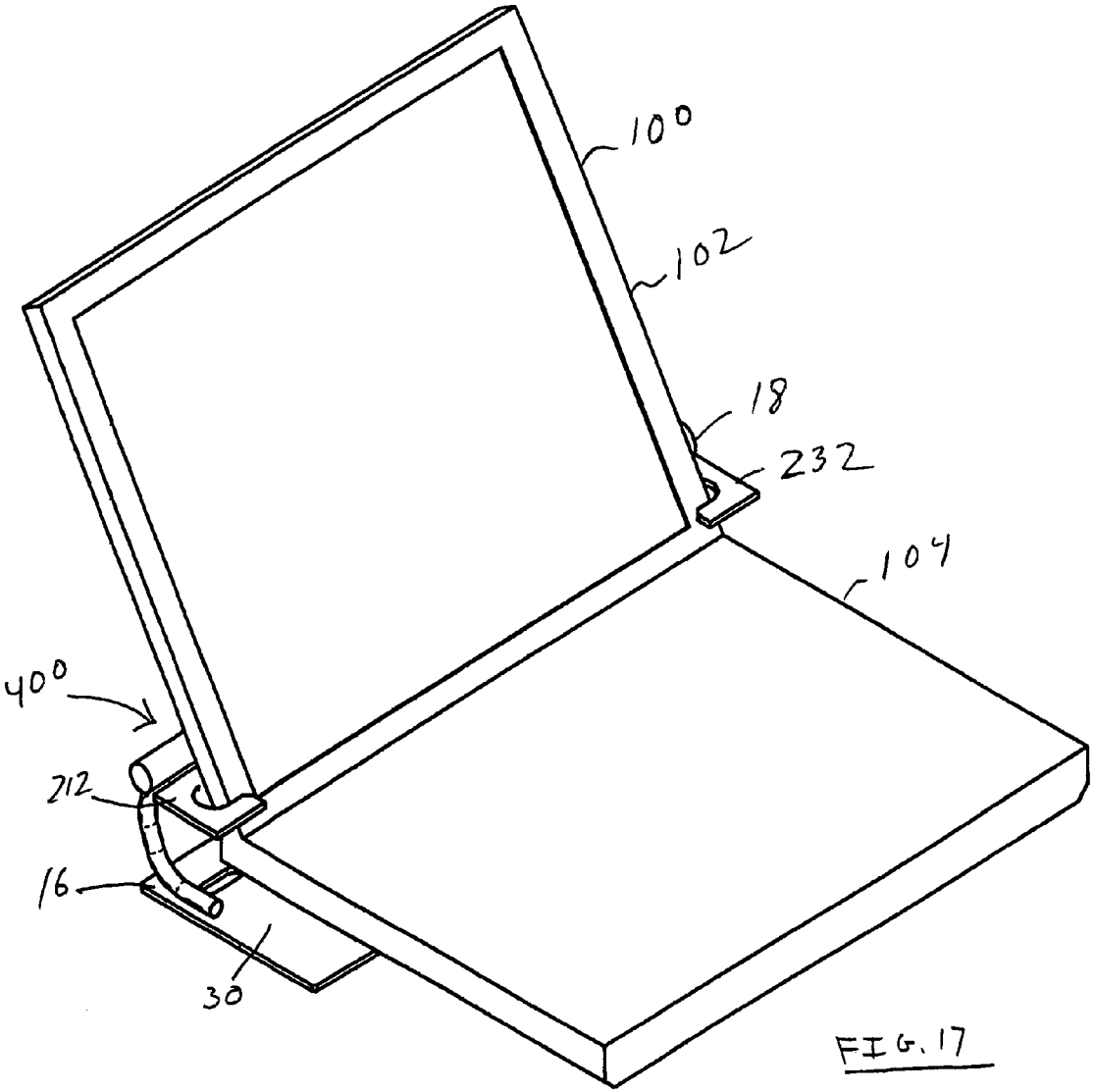
FIG. 17 is a perspective view the security device of FIG. 16 securing an open laptop computer.

FIG. 17 shows the security device 400 securing laptop computer 100 in an open position. Opposite side edge portions of the open cover 102 are received and restrained within the opposed openings 220 and 240 that are defined by U-shaped plates 212 and 232, respectively. Base plates 30 and 46 extend under the base 104 of the laptop, and the locking arm 20 and sleeve 24 are located behind the open cover 102. The absence of forward sidewall engagement members on security device 400 (as opposed to security device 200) provides unhindered access to the side edges of the laptop base, as some laptops may have cable ports or storage medium access located along such sides.

Figure 18:
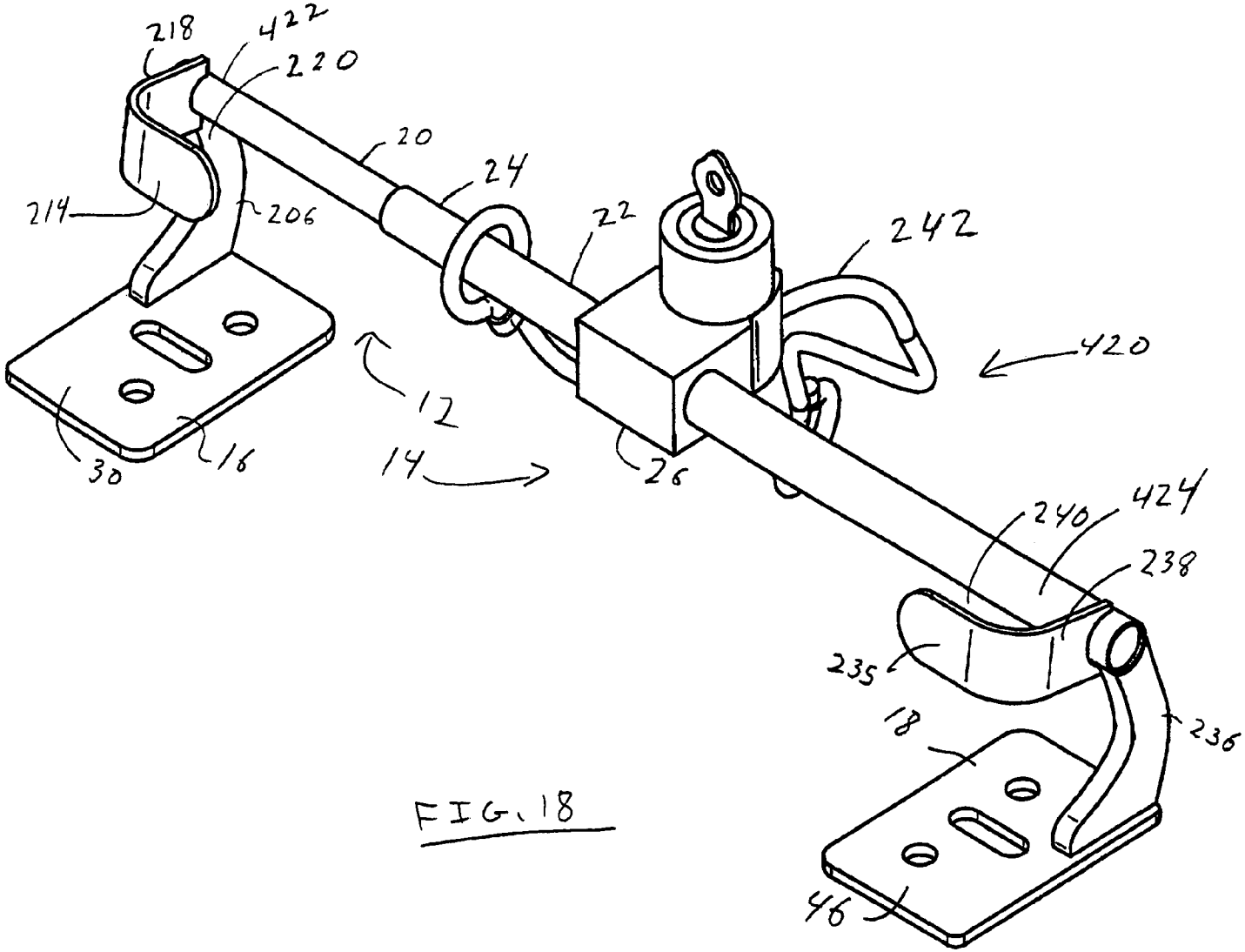
FIG. 18 is a perspective view of a security device in accordance with a further example embodiment of the invention.

FIG. 18 shows yet a further example embodiment of a security device 420 for securing a laptop in an open position, the device 420 is similar in construction and operation to device 400 except as will be apparent from the present description and the Figures. In the device 420, the U-shaped opening 220 of the first restraining member 16 is defined by front restraining member 214, side restraining member 218, and an outer end portion 422 of the locking arm 20. Similarly, the opposing U-shaped opening 240 of the second restraining member 18 is defined by front restraining member 235, side restraining member 238, and an outer end portion 424 of the locking sleeve 24.

Figure 19:
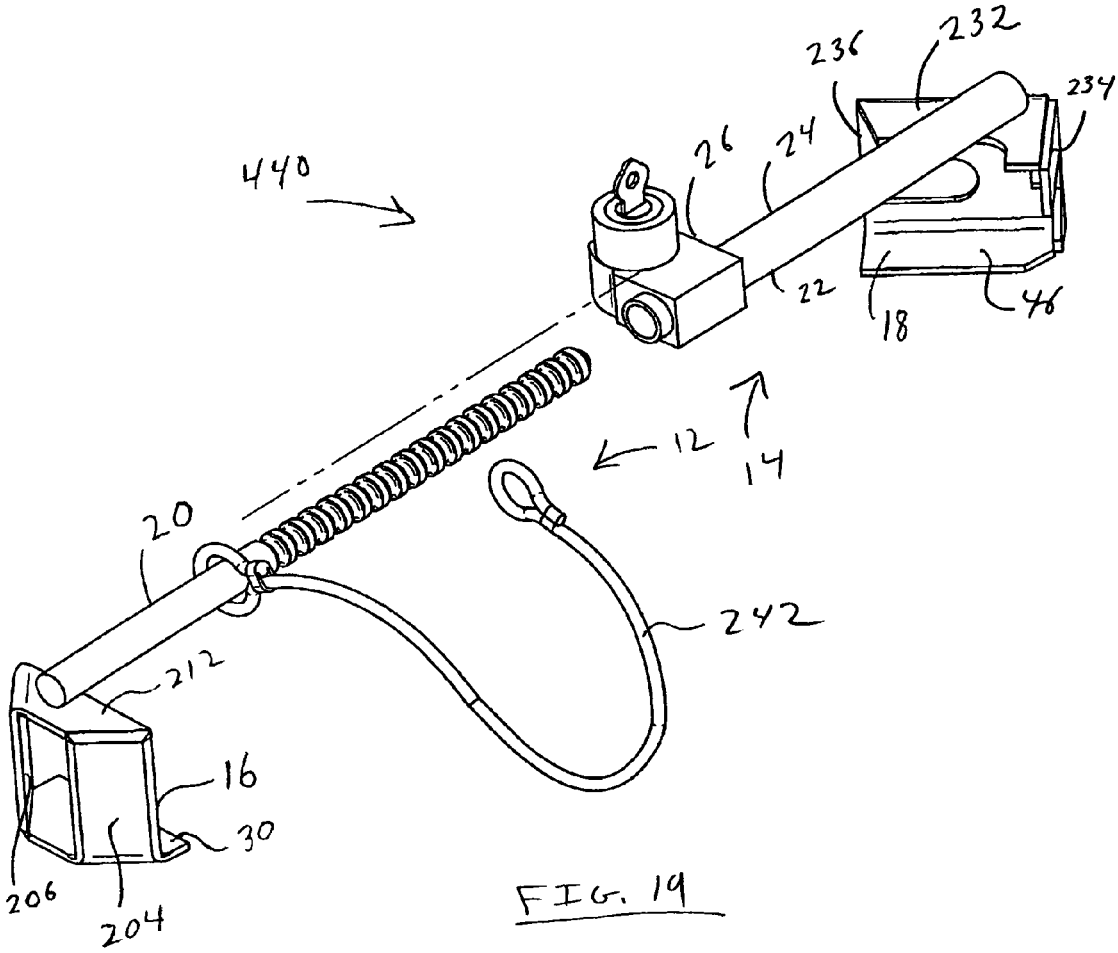
FIG. 19 is a perspective view of a security device in accordance with a further example embodiment of the invention.
Figure 20:
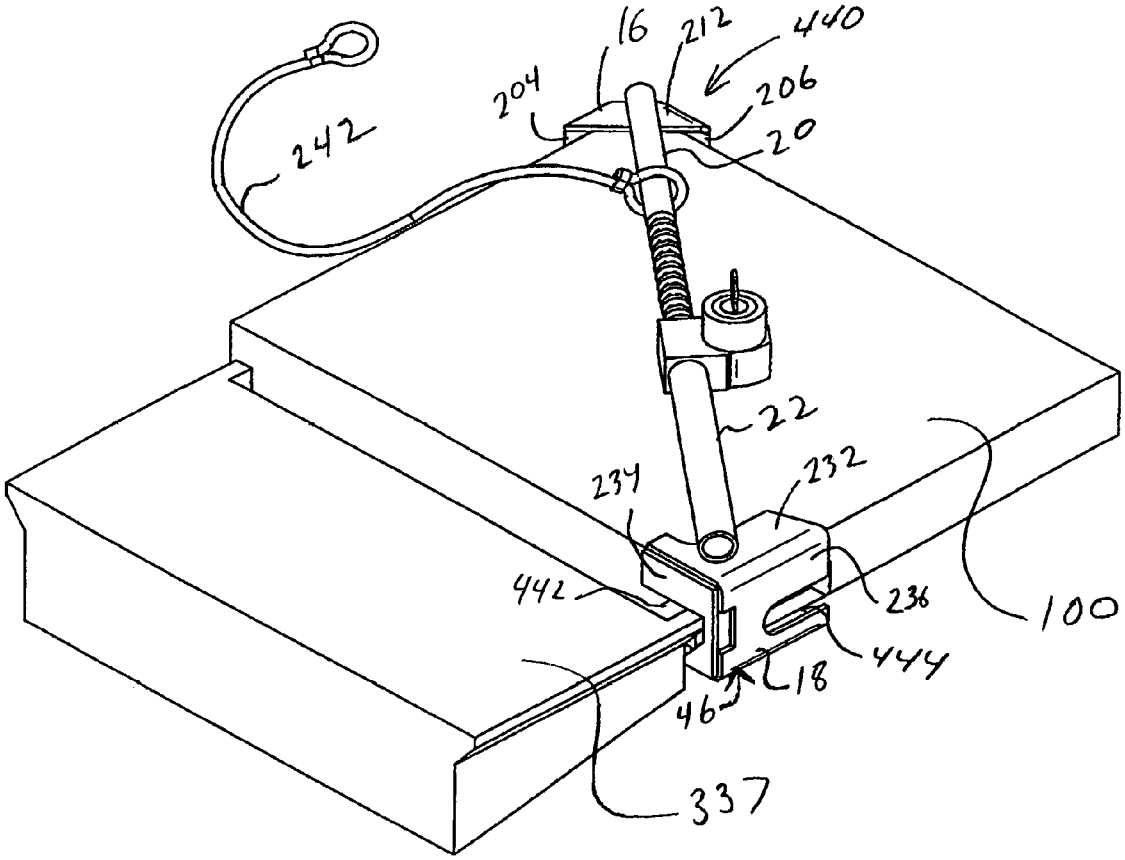
FIG. 20 is a perspective view the security device of FIG. 19 securing a closed laptop computer.

As noted above, in some embodiments (including the example shown in FIG. 10), the securing device may be configured to secure only closed laptop computers, and in this regard FIGS. 19 and 20 show yet a further example embodiment of a security device 440 for securing a closed laptop computer. As with security devices 10, 200, 260, 300 and 330 described above, the device 440 includes first and second securing members 12, 14 having, respectively, first and second restraining members 16, 18 for engaging diagonally opposite corners of a closed laptop when locking arm 20 of the first securing member 12 is received within the locking device 22 of the second securing member 14. The first restraining member 16 includes a base plate 30, first and second sidewall engagement members 204, 206, and an upper plate 212 arranged in spaced apart opposition to the base plate 30. Similarly, the second restraining member 18 includes a base plate 46, first and second sidewall engagement members 234, 236, and an upper plate 232 arranged in spaced apart opposition to the base plate 46. In the embodiment of FIGS. 19 and 20, the first and second sidewall engagement members 204 and 206 of the first restraining member 16 are plate-like wall members that are arranged at substantially orthogonal angles relative to each other. Similarly, the first and second sidewall engagement members 234 and 246 of the second restraining member 18 are also plate-like wall members that are arranged at substantially orthogonal angles relative to each other.

As seen in FIG. 20, when the device 440 is used to secure a closed laptop computer 100, the second restraining member 18 engages one corner of the closed laptop, with the opposed base plate 46 and upper plate 232 each respectively being located adjacent opposite facing bottom and top surfaces of the laptop, and the sidewall engagement members 236 and 234 being located adjacent a respective one of an orthogonal pair of the laptop's sidewalls. Similarly, the first restraining member 16 engages a diagonally opposite corner of the closed laptop, with the opposed base plate 30 and upper plate 212 each respectively being located adjacent opposite facing bottom and top surfaces of the laptop, and the sidewall engagement members 204 and 206 being located adjacent a respective one of an orthogonal pair of the laptop's sidewalls. The closed laptop 100 is thus clamped shut within the security device 440 which can be secured to a stationary structure via cable 242 or a bolt or other securing means.

As shown in FIG. 20, in the example embodiment illustrated, a slot-like opening is provided in the sidewall engagement member 234 for accommodating a docking station 337, and the sidewall engagement member 236 may include a similar opening for provide access to a cable port, cooling fan or storage media opening on the side edge of the laptop.

Figure 21:
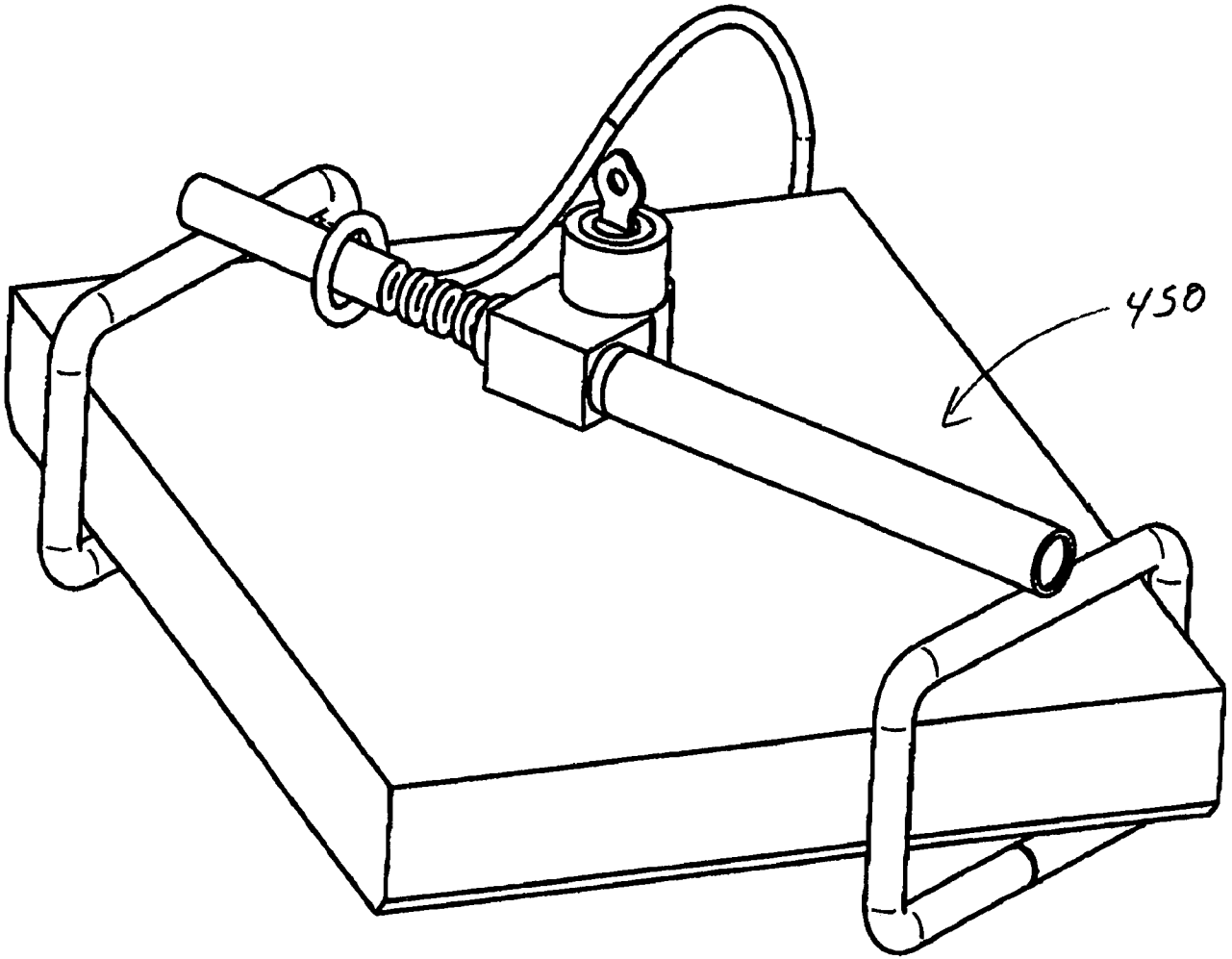
FIG. 21 is a perspective view of a security device in accordance with a further example embodiment of the invention.
Figure 22:
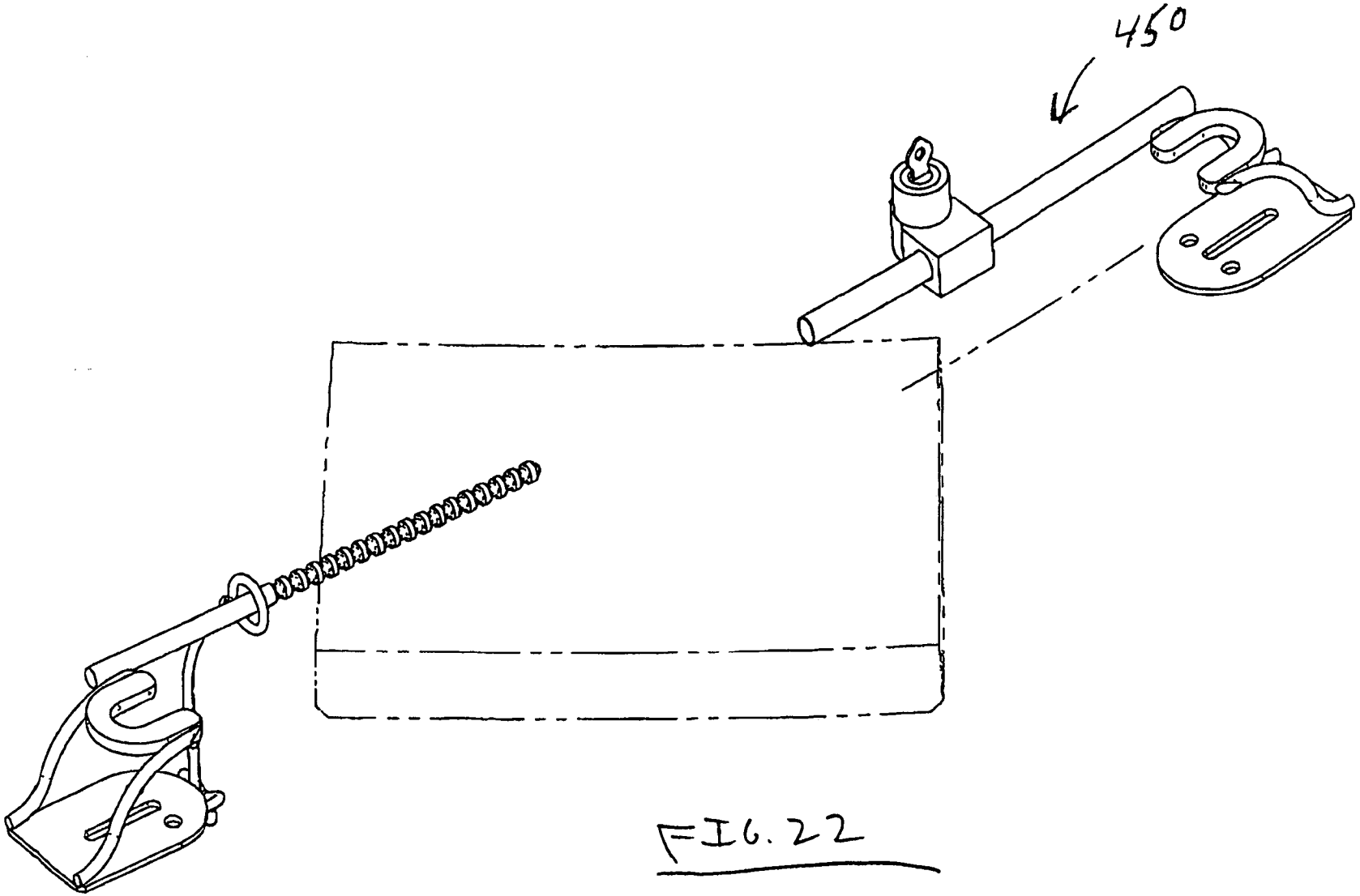
FIG. 22 is a perspective view of a security device in accordance with a further example embodiment of the invention.
Figure 23:
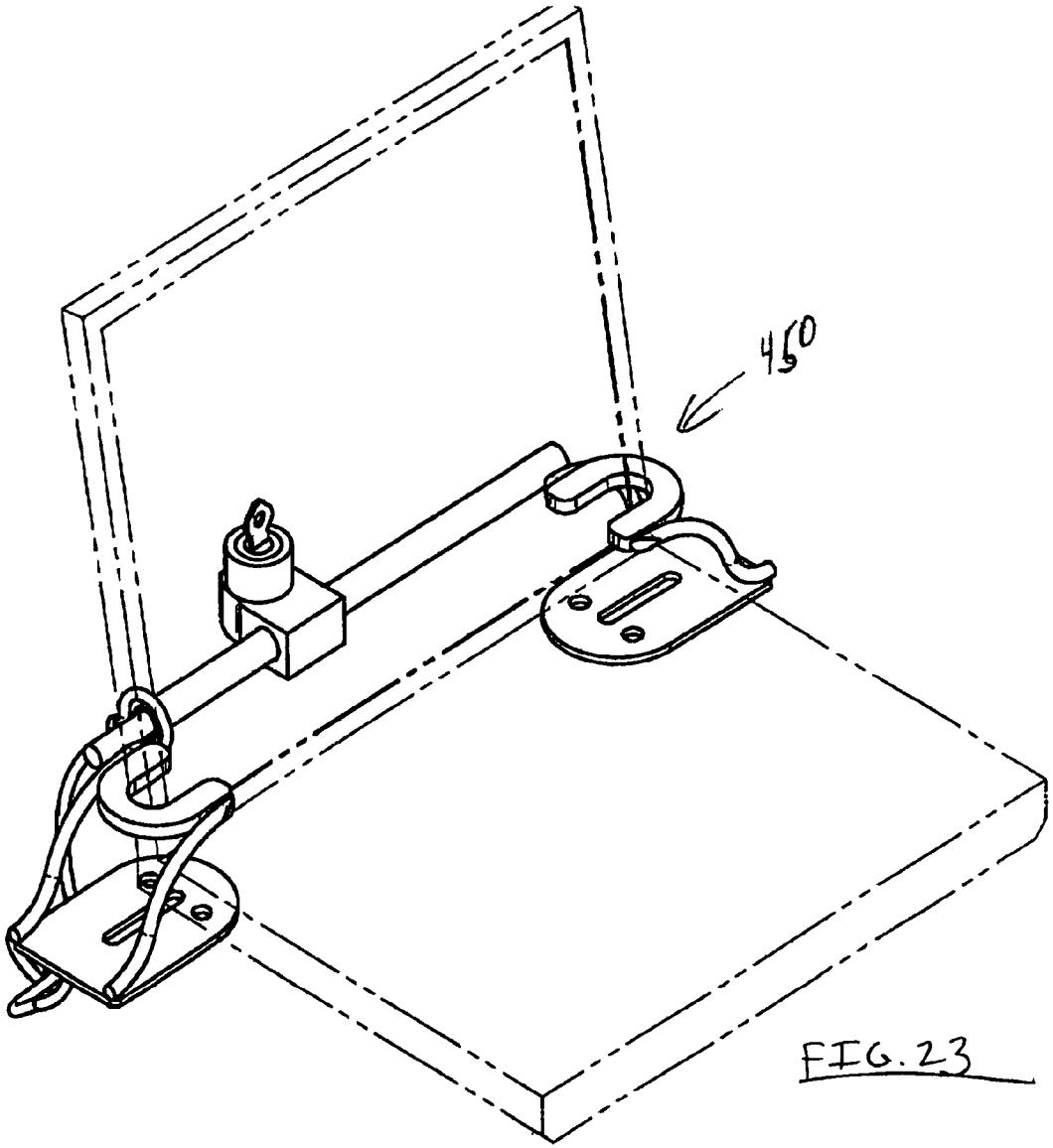
FIG. 23 is a perspective view the security device of FIG. 22 securing an open laptop computer.

FIG. 21 shows yet a further embodiment of a security device 450 according to the present invention that can be used to secure a closed laptop computer in a manner similar to the security devices described above. FIGS. 22 and 23 show yet another example embodiment of a security device 450 according to the present invention that, except for differences that will be apparent from the Figures, is substantially similar to device 200, and which can be used to secure laptop computers in both the opened and closed positions.

As will be apparent to those skilled in the art in the light of the foregoing disclosure, many alterations and modifications are possible in the practice of this invention without departing from the sprit or scope thereof. The foregoing description is of the example embodiments and is by way of example, and is not to limit the scope of the invention as set forth in the following claims.

What is claimed is:

1. A security device for securing a laptop computer, the security device comprising:

a first securing member including a first restraining member and an elongate arm; and a second securing member including a second restraining member opposing the first restraining member and a releasable locking device telescopically engaging the arm for preventing movement of the first and second restraining members away from each other when in an engagement position;

the first and second restraining members each including spaced apart cover and base wall engagement members and a pair of side-wall engagement members for engaging a cover wall, base wall, and a pair of orthogonal side-walls, respectively, at diagonally opposite corners, respectively, of a closed laptop computer when in the engagement position, wherein for each of the first and second restraining members, the cover wall engagement member defines an opening for receiving a side edge portion of an open cover of the laptop computer such that the restraining member can also secure an open laptop computer with opposite side edges of the open cover of the laptop computer being received within the openings of the cover wall engagement members of the first and second restraining members, respectively.

2. The security device of claim 1 wherein for each of the first and second restraining members at least one of the side-wall engagement members thereof rigidly connects the cover wall engagement member thereof to the base wall engagement member thereof.

3. The security device of claim 2 wherein for each of the first and second restraining members the cover wall engagement member thereof is substantially parallel to the base wall engagement member thereof.

4. The security device of claim 1 wherein for each of the first and second retraining members the pair of side-wall engagement members include wall sections with the wall section of one sidewall engagement member of the pair being substantially orthogonal to the wall section of the other of sidewall engagement member of the pair.

5. The security device of claim 4 wherein at least some of the wall sections include openings there through for accommodating a docking station to which the laptop computer is docked.

6. The security device of claim 1 wherein the arm has a plurality of teeth formed along a length thereof and the locking device includes a tubular sleeve in which the arm is telescopically received and a locking apparatus having a pawl for selectively engaging at least one of the teeth when the locking device is in the engagement.

7. The security device of claim 1 including a cable and associated lock for securing the security device to a structure.

8. A method of securing a laptop computer including:

providing a security device having a pair of rigid opposed restraining members telescopically connected together, each of the restraining members including spaced apart cover and base wall engagement members and a rigid pair of side-wall engagement members for engaging a cover wall, base wall, and a pair of orthogonal side-walls, respectively, at diagonally opposite corners, respectively, of a closed laptop computer;

mounting the security device to a closed laptop computer with the restraining members engaging diagonally opposite corners of the closed laptop computer.

9. A security device for securing a laptop computer having a base and a cover pivotally connected together for movement between open and closed positions, the security device comprising:

opposed first and second restraining members telescopically connected together, each of the restraining members having a laptop cover engagement member, a base member that is substantially parallel to the cover engagement member for extending under a portion of a laptop base, and a joining member joining the base and cover engagement members, the cover engagement members defining opposed openings for receiving opposite side-edge portions of an open cover of a laptop computer when the cover is open and the base members extend under respective portions of the laptop base for securing the laptop relative to the security device.

10. The security device of claim 9 including an elongate arm extending from the first restraining member and a locking device on the second retraining member for telescopically receiving the elongate arm and selectively locking the opposed first and second restraining members at selected distances relative to each other.

11. The security device of claim 9 wherein the openings are generally U-shaped.

12. A security device for securing a laptop computer in either an open position or a closed position, comprising:

opposed first and second restraining members telescopically connected together and lockable relative to each other in a plurality of positions, the restraining members each including: means for engaging the cover and base of an open laptop computer for restraining movement of the laptop when the restraining members are locked in a first one of the plurality of positions and means for engaging diagonally located corners of a closed laptop computer for restraining movement thereof when the restraining members are locked in a further one of the plurality of positions;

wherein the cover and base engaging means and diagonally located corner engaging means collectively include:

base engagement means for extending under a portion of a base of a laptop computer;

cover engagement means for engaging a side edge portion of the cover of the laptop computer when the laptop computer is in the open position; and sidewall engagement means for engaging a pair of orthogonal sidewalls of the laptop computer when the laptop computer is in the closed position.

13. The security device of claim 12 including a locking arm extending from the first restraining member and a locking device on the second restraining member telescopically engaging the elongate arm.

14. The security device of claim 13 wherein the arm includes a plurality of ratchet teeth spaced along a length thereof, and said locking device has a pawl movable between a locked position in which the pawl engages a selected one of the ratchet teeth thereby preventing movement of the first and second restraining members away from each other, and an unlocked position in which the pawl is disengaged from the ratchet teeth such that the first and second restraining members can be moved away from each other, the pawl being spring loaded to permit the locking device to be telescoped onto the arm while preventing it to be removed therefrom when the locking device is in the locked position.

15. A security device for securing a laptop computer having a base and a cover pivotally connected together for movement between open and closed positions, the security device comprising:

opposed first and second restraining members telescopically connected together, each of the restraining members having a laptop cover engagement member, a base member that includes a substantially planer plate for extending under a portion of a laptop base, and ajoining member joining the base and cover engagement members, the cover engagement members defining opposed openings for receiving opposite side-edge portions of an open cover of a laptop computer when the cover is open and the base members extend under respective portions of the laptop base for securing the laptop relative to the security device.

16. The security device of claim 15 comprising an elongate arm extending from the first restraining member and a locking device on the second restraining member for telescopically receiving the elongate arm and selectively locking the opposed first and second restraining members at selected distances relative to each other.

17. The security device of claim 16 wherein the elongate arm extends from the cover engagement member of the first restraining member and the locking device extends from the cover engagement member of the second restraining member such that the elongate arm is located behind the cover of the laptop computer when the security device is used to secure the laptop computer in an open position, the elongate arm being substantially parallel to the planer plate of the base member of the first restraining member.

* * * * *